US010732564B2

(12) United States Patent
Kobayashi et al.

(10) Patent No.: US 10,732,564 B2
(45) Date of Patent: Aug. 4, 2020

(54) ROTATING DEVICE AND IMAGE FORMING APPARATUS

(71) Applicant: FUJI XEROX CO., LTD., Tokyo (JP)

(72) Inventors: Akihiro Kobayashi, Kanagawa (JP); Takuji Matsumoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/391,249

(22) Filed: Apr. 22, 2019

(65) Prior Publication Data

US 2020/0192272 A1 Jun. 18, 2020

(30) Foreign Application Priority Data

Dec. 18, 2018 (JP) ..... 2018-236596

(51) Int. Cl.
*G03G 21/16* (2006.01)
*G03G 15/08* (2006.01)

(52) U.S. Cl.
CPC ..... *G03G 21/1647* (2013.01); *G03G 15/0867* (2013.01); *G03G 21/1676* (2013.01)

(58) Field of Classification Search
CPC ..... G03G 21/1676; G03G 21/1647; G03G 15/0867; G03G 15/087
See application file for complete search history.

(56) References Cited

U.S. PATENT DOCUMENTS 7,321,744 B2 * 1/2008 Hosokawa ..... G03G 15/0872 399/258
8,478,163 B2 * 7/2013 Sato ..... G03G 21/1821 399/113
9,448,527 B1 * 9/2016 Ninomiya ..... G03G 21/1647

FOREIGN PATENT DOCUMENTS

JP 2003066706 3/2003

* cited by examiner

*Primary Examiner* — Gregory H Curran
(74) *Attorney, Agent, or Firm* — JCIPRNET

(57) ABSTRACT

A rotating device includes a body having a bottom wall extending in one direction; a holding object including a rotating portion extending in the one direction and a supporting portion supporting the rotating portion at one end of the rotating portion in the one direction such that the rotating portion is rotatable on an axis extending in the one direction, the holding object being provided on the bottom wall; a first holding portion provided on the body and holding the supporting portion of the holding object at one end of the supporting portion in the one direction; a second holding portion provided on the body and holding the supporting portion of the holding object at an other end of the supporting portion in the one direction; and a transmitting portion provided on the body and transmitting a rotational force to the rotating portion of the holding object.

20 Claims, 24 Drawing Sheets

ROTATING DEVICE AND IMAGE FORMING APPARATUS

CROSS-REFERENCE TO RELATED APPLICATIONS

This application is based on and claims priority under 35 USC 119 from Japanese Patent Application No. 2018-236596 filed Dec. 18, 2018.

BACKGROUND

(i) Technical Field

The present disclosure relates to a rotating device and an image forming apparatus.

(ii) Related Art

A developer supplying device disclosed by Japanese Unexamined Patent Application Publication No. 2003-66706 includes a developer storing container in which developer is stored. The developer storing container is rotatably supported at two axial ends thereof. When the developer storing container is rotated, the developer in the developer storing container is transported in the axial direction by a helical ridge provided in the developer storing container.

SUMMARY

Here, a holding object provided on a bottom wall of a certain body and including a rotating portion and a supporting portion that supports the rotating portion rotatably will be discussed. When the rotating portion is rotated with the supporting portion being held by a holding portion provided on the body, the orientation of the holding object may change.

Aspects of non-limiting embodiments of the present disclosure relate to more assuredly suppressing the change in the orientation of the holding object that may occur with the rotation of the rotating portion than in a configuration in which the supporting portion is held only at one end thereof.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a rotating device that includes a body having a bottom wall extending in one direction; a holding object including a rotating portion extending in the one direction and a supporting portion supporting the rotating portion at one end of the rotating portion in the one direction such that the rotating portion is rotatable on an axis extending in the one direction, the holding object being provided on the bottom wall; a first holding portion provided on the body and holding the supporting portion of the holding object at one end of the supporting portion in the one direction; a second holding portion provided on the body and holding the supporting portion of the holding object at an other end of the supporting portion in the one direction; and a transmitting portion provided on the body and transmitting a rotational force to the rotating portion of the holding object.

BRIEF DESCRIPTION OF THE DRAWINGS

An exemplary embodiment of the present disclosure will be described in detail based on the following figures, wherein.

DETAILED DESCRIPTION

Figure 1:
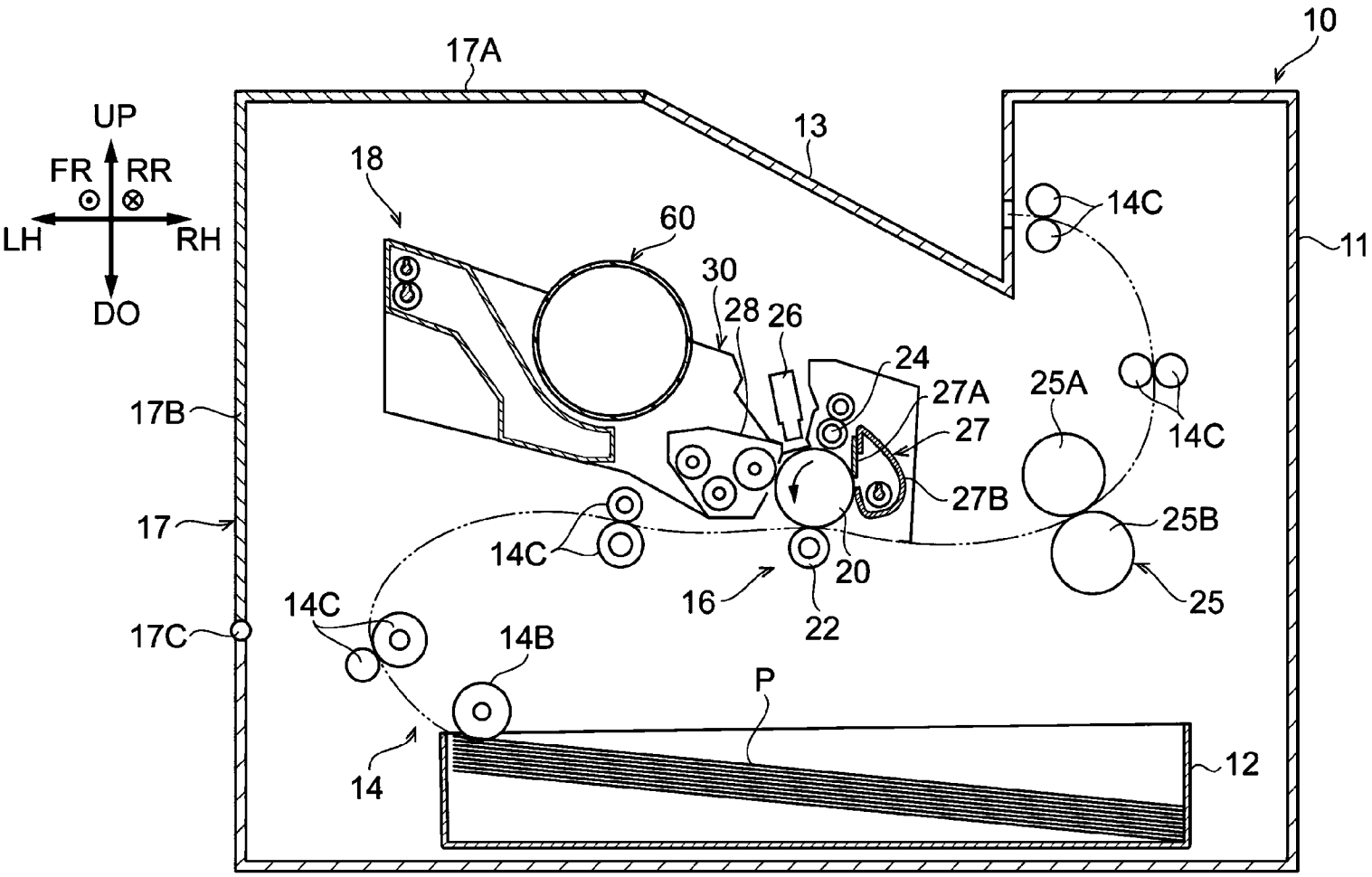
FIG. 1 is a schematic diagram of an image forming apparatus according to the exemplary embodiment.

An exemplary embodiment of the present disclosure will now be described with reference to the drawings.

In the drawings, arrow UP points toward the upper side (the upper side in the vertical direction) of an apparatus, arrow DO points toward the lower side (the lower side in the vertical direction) of the apparatus, arrow LH points toward the left side of the apparatus, arrow RH points toward the right side of the apparatus, arrow FR points toward the front side of the apparatus, and arrow RR points toward the rear side of the apparatus. These directions are defined for convenience of description and do not limit the configuration of the apparatus. The above terms representing the directions of the apparatus may be used without the term "apparatus". For example, "the upper side of the apparatus" may also be referred to as "the upper side", simply.

In the following description, the term "vertical direction" refers to "directions toward both the upper side and the lower side" or "a direction toward one of the upper side and the lower side". Likewise, the term "horizontal direction" refers to "directions toward both the right side and the left side" or "a direction toward one of the right side and the left side". The term "horizontal direction" corresponds to the width direction of the apparatus and is also regarded as a lateral direction or a level direction. The term "front-rear direction" refers to "directions toward both the front side and the rear side" or "a direction toward one of the front side and the rear side". The "front-rear direction" corresponds to the depth direction of the apparatus and is also regarded as another lateral direction or another level direction. The vertical direction, the horizontal direction, and the front-rear direction are directions intersecting one another (specifically, directions orthogonal to one another).

The front-rear direction is an exemplary one direction. The term "one direction" is used as "a particular one of several directions".

In addition, an encircled cross represents an arrow heading from the near side toward the far side with respect to the plane of each of the drawings, and an encircled dot represents an arrow heading from the far side toward the near side with respect to the plane of each of the drawings.

Image Forming Apparatus 10

An image forming apparatus 10 according to an exemplary embodiment will now be described. FIG. 1 is a schematic diagram of the image forming apparatus 10 according to the present exemplary embodiment.

The image forming apparatus 10 illustrated in FIG. 1 is an exemplary image forming apparatus that forms an image on a recording medium. Specifically, the image forming apparatus 10 is an electrophotographic image forming apparatus that forms a toner image (an exemplary image) on a sheet P (an exemplary recording medium). More specifically, the image forming apparatus 10 includes an image-forming-apparatus body 11, an openable-closable portion 17, a sheet container 12, a transport section 14, and an image forming section 16. Now, individual elements of the image forming apparatus 10 will be described.

Image-Forming-Apparatus Body 11 and Openable-Closable Portion 17

The image-forming-apparatus body 11 serves as a housing that houses relevant elements. The openable-closable portion 17 is openably and closably attached to the image-forming-apparatus body 11.

The openable-closable portion 17 has an L shape when seen in the front-rear direction. Specifically, the openable-closable portion 17 includes a top plate 17A positioned above an image forming unit 18, and a side plate 17B positioned on the left side of the image forming unit 18. The openable-closable portion 17 further includes a rotating shaft 17C provided at the lower end of the side plate 17B and whose axis extends in the front-rear direction.

The openable-closable portion 17 is rotatable on the rotating shaft 17C, thereby being movable between a closed position (see FIG. 1) at which the openable-closable portion 17 covers the interior of the image-forming-apparatus body 11 and an open position (see FIG. 2) at which the openable-closable portion 17 exposes the interior of the image-forming-apparatus body 11.

Sheet Container 12 and Sheet Output Portion 13

The sheet container 12 is a container in which sheets P are contained in such a manner as to be stacked one on top of another. The sheet container 12 is positioned at the bottom of the image-forming-apparatus body 11.

A sheet output portion 13 is an output portion to which sheets P are outputted. The sheet output portion 13 receives sheets P that are outputted one by one from the image-forming-apparatus body 11 in such a manner as to be stacked thereon. The sheet output portion 13 is provided at the top (in the upper surface) of the image-forming-apparatus body 11.

Transport Section 14

The transport section 14 transports each of the sheets P. Specifically, the transport section 14 has a function of transporting the sheets P one by one from the sheet container 12 to the sheet output portion 13. More specifically, the transport section 14 includes a feed roller 14B and a plurality of pairs of transport rollers 14C. The feed roller 14B feeds the sheets P one by one from the sheet container 12. The plurality of pairs of transport rollers 14C receive each sheet P fed thereto by the feed roller 14B and transport the sheet P to the sheet output portion 13 via the image forming section 16.

Image Forming Section 16

The image forming section 16 forms an image. Specifically, the image forming section 16 has a function of forming an image on the sheet P with toner. The toner is exemplary powder.

More specifically, the image forming section 16 includes the image forming unit 18, an exposure device 26, a transfer roller 22, and a fixing device 25. The image forming unit 18 forms a black toner image. The black toner image is an exemplary image. The image forming unit 18 includes a photoconductor drum 20, a charging roller 24 as a charging device, a developing device 28, and a remover 27. The photoconductor drum 20 is an exemplary photoconductor.

The photoconductor drum 20 rotates in one direction (counterclockwise in FIG. 1). The charging roller 24, the exposure device 26, the developing device 28, the transfer roller 22, and the remover 27 are arranged around the photoconductor drum 20 in that order from the upstream side in the direction of rotation of the photoconductor drum 20.

In the image forming unit 18, the charging roller 24 charges the photoconductor drum 20. The charged photoconductor drum 20 is exposed to light emitted from the exposure device 26, whereby an electrostatic latent image (an exemplary latent image) is formed thereon. The developing device 28 develops the electrostatic latent image formed on the photoconductor drum 20 by the exposure device 26 into a toner image. The toner image formed by the developing device 28 is transferred to a sheet P by the transfer roller 22.

The remover 27 removes toner remaining on the surface of the photoconductor drum 20 having undergone the above transfer. Specifically, the remover 27 includes a blade 27A as a removing member that is in contact with the surface of the photoconductor drum 20 and thus removes (scrapes) the toner, and a toner storage portion 27B that stores the toner removed by the blade 27A. More details of the image forming unit 18 will be described separately below.

The fixing device 25 fixes the toner image transferred to the sheet P. Specifically, the fixing device 25 includes a heating roller 25A and a pressing roller 25B. In the fixing device 25, the toner image on the sheet P is fixed with heat and pressure applied thereto from the heating roller 25A and the pressing roller 25B, respectively.

Details of Image Forming Unit 18

Details of the image forming unit 18 will now be described.

Figure 2:
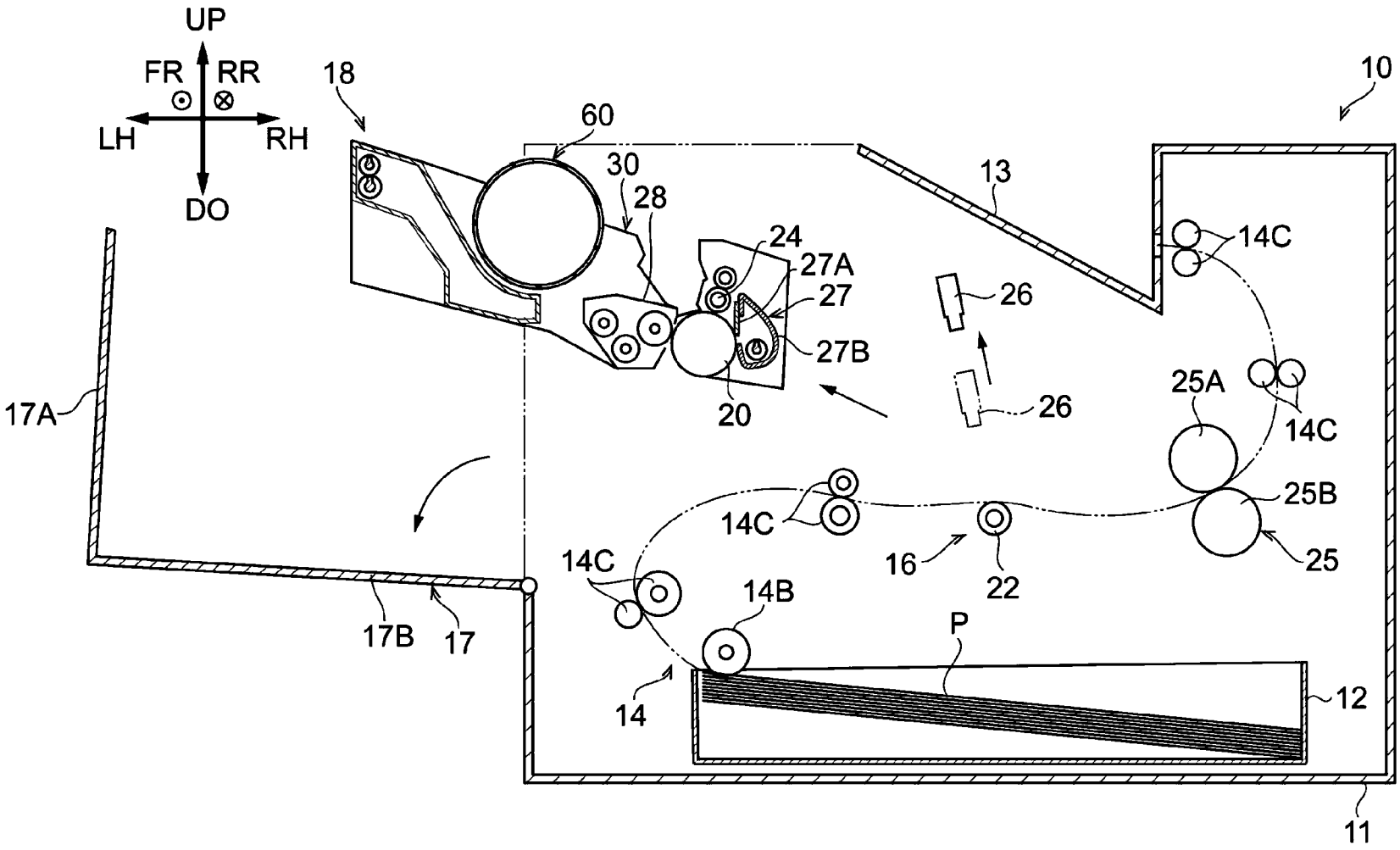
FIG. 2 is a schematic diagram of the image forming apparatus illustrated in FIG. 1, with an openable-closable portion being open.

The image forming unit 18 illustrated in FIGS. 1 and 2 is an exemplary rotating device and is attachable to and detachable from the image-forming-apparatus body 11. Specifically, the image forming unit 18 is provided in the form of an exchangeable process cartridge intended for the image-forming-apparatus body 11. As illustrated in FIG. 2, when the openable-closable portion 17 is at the open position, the image forming unit 18 is allowed to be attached to or detached from the image-forming-apparatus body 11. More specifically, the image forming unit 18 is allowed to be attached to or detached from the image-forming-apparatus body 11 with, for example, the exposure device 26 being retracted to such a position as not to interfere with the image forming unit 18. In FIG. 2, the exposure device 26 that is not retracted is illustrated by a two-dot chain line, and the exposure device 26 that is retracted is illustrated by a solid line.

Figure 5:
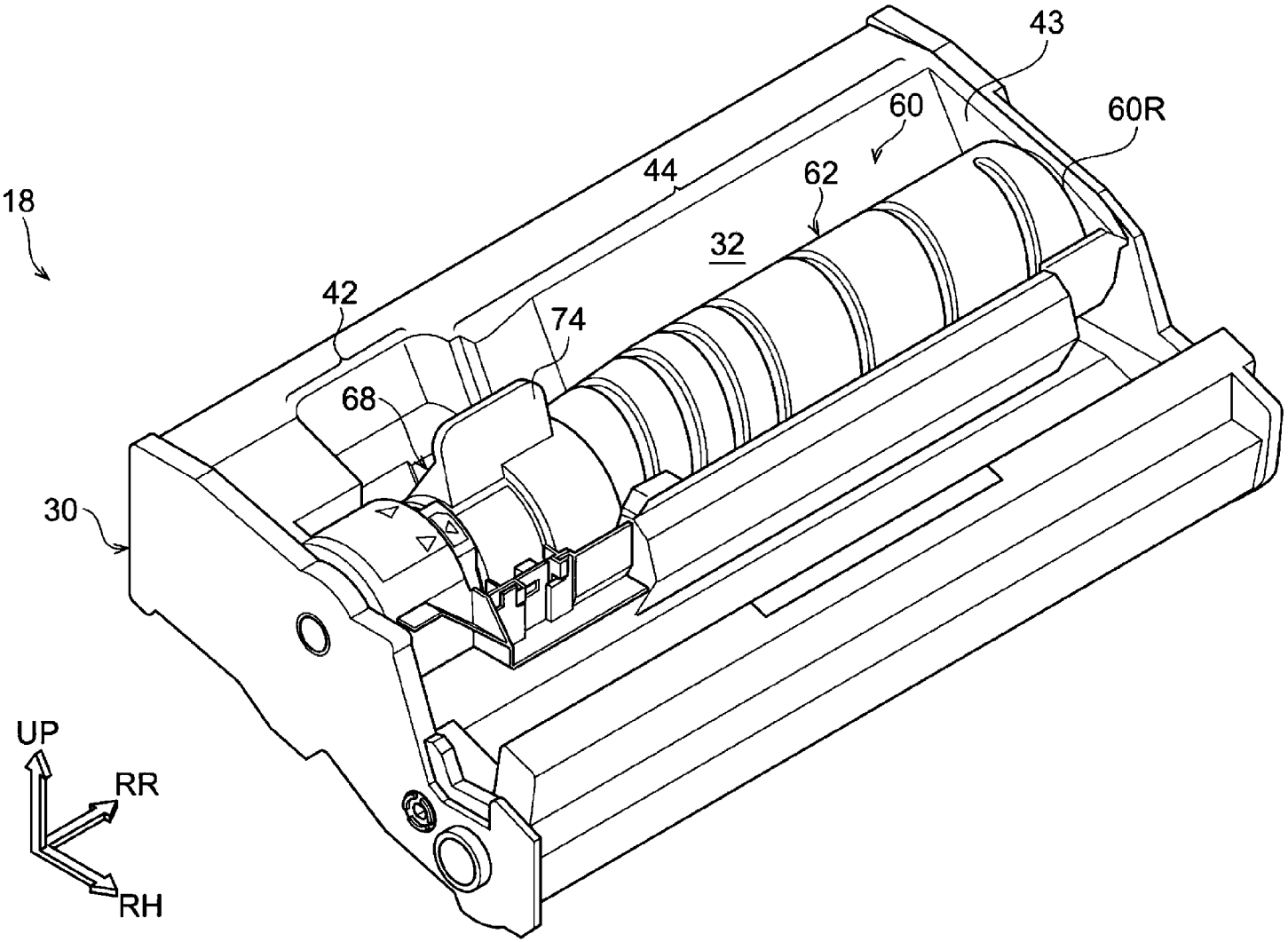
FIG. 5 is a perspective view of the image forming unit illustrated in FIG. 3, with a storage container being in an unset position.
Figure 6:
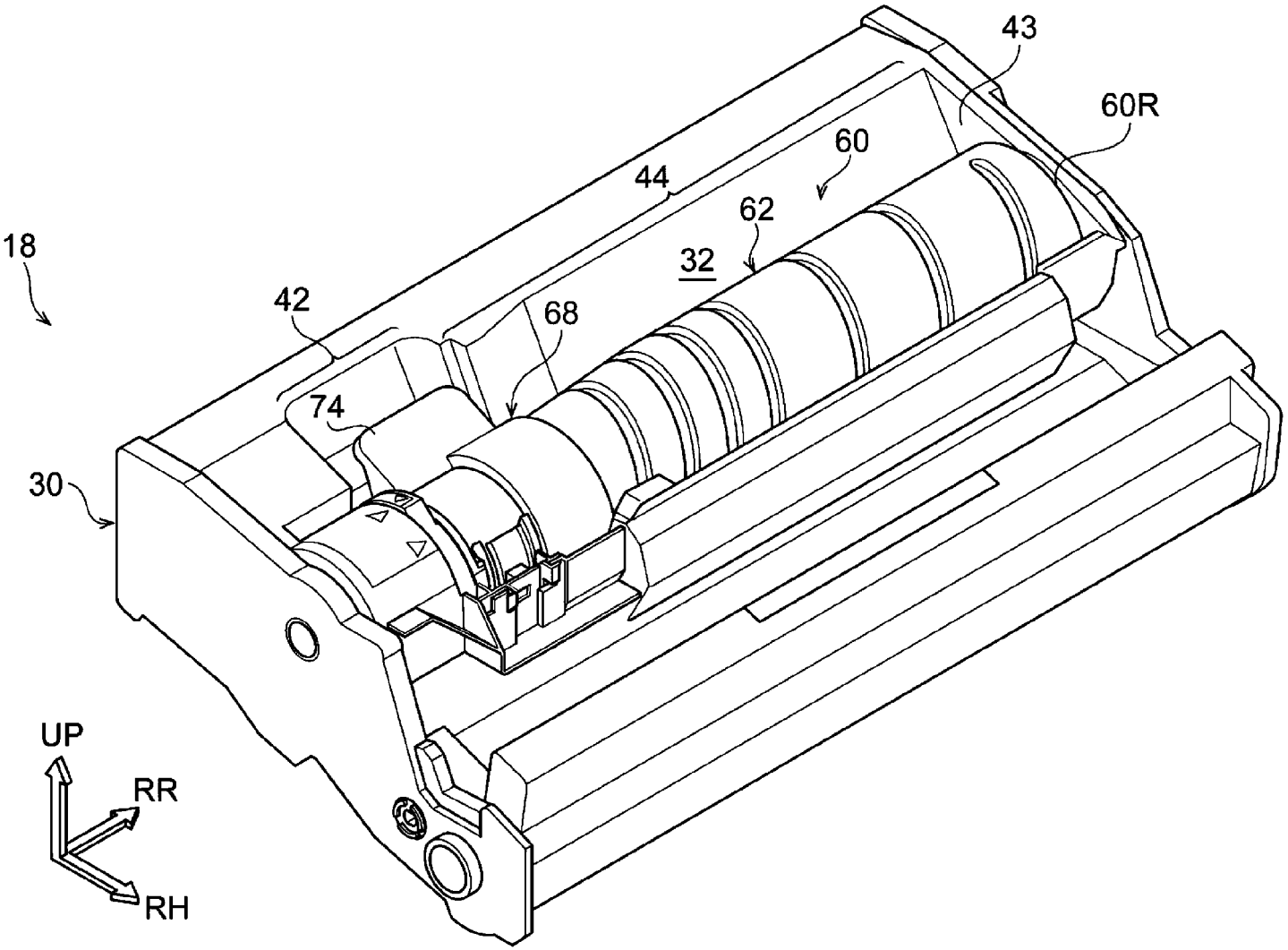
FIG. 6 is a perspective view of the image forming unit illustrated in FIG. 4, with the storage container being in a set position.
Figure 10:
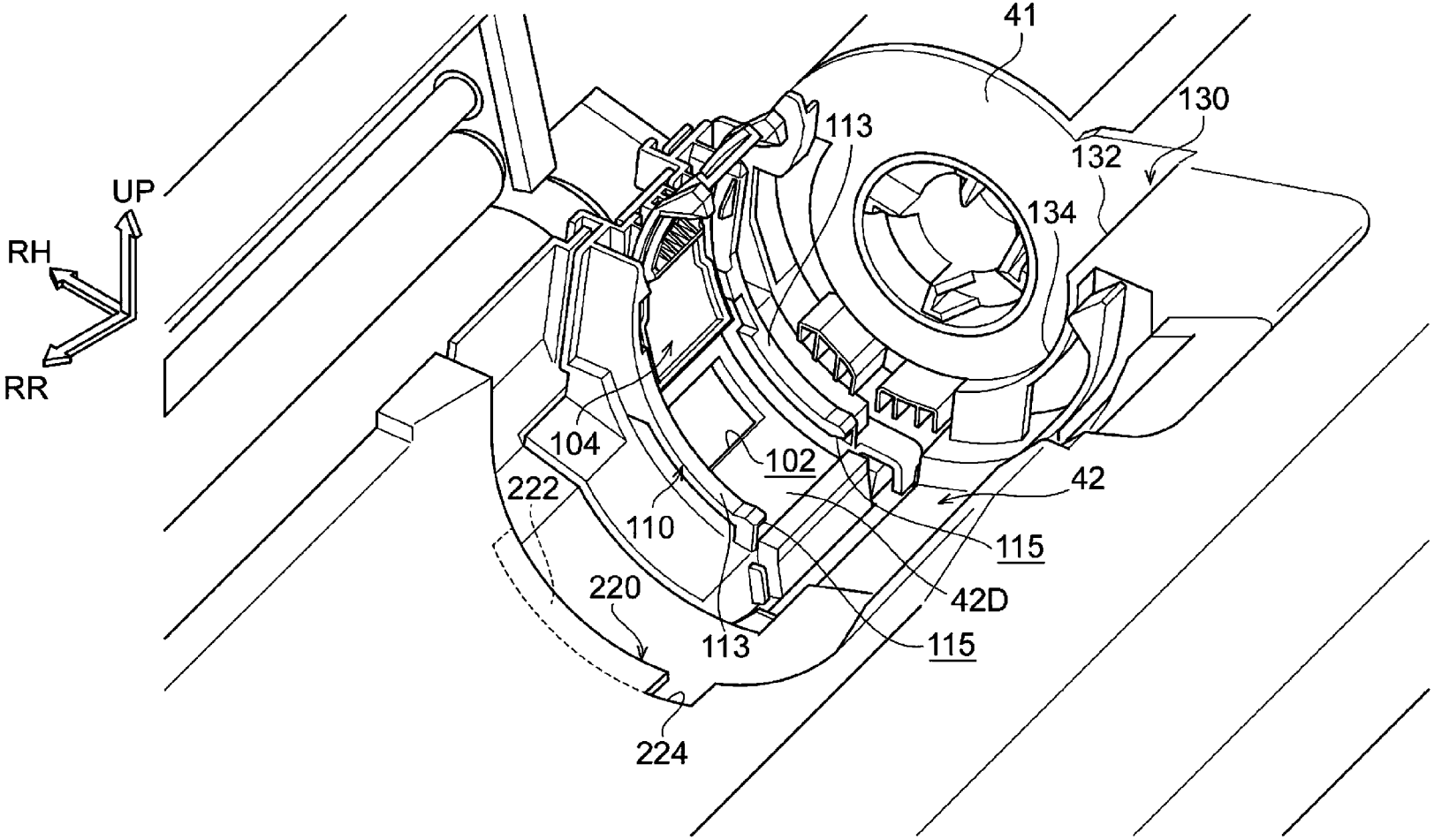
FIG. 10 is an enlarged perspective view of the image forming unit according to the exemplary embodiment, illustrating a front peripheral wall.
Figure 11:
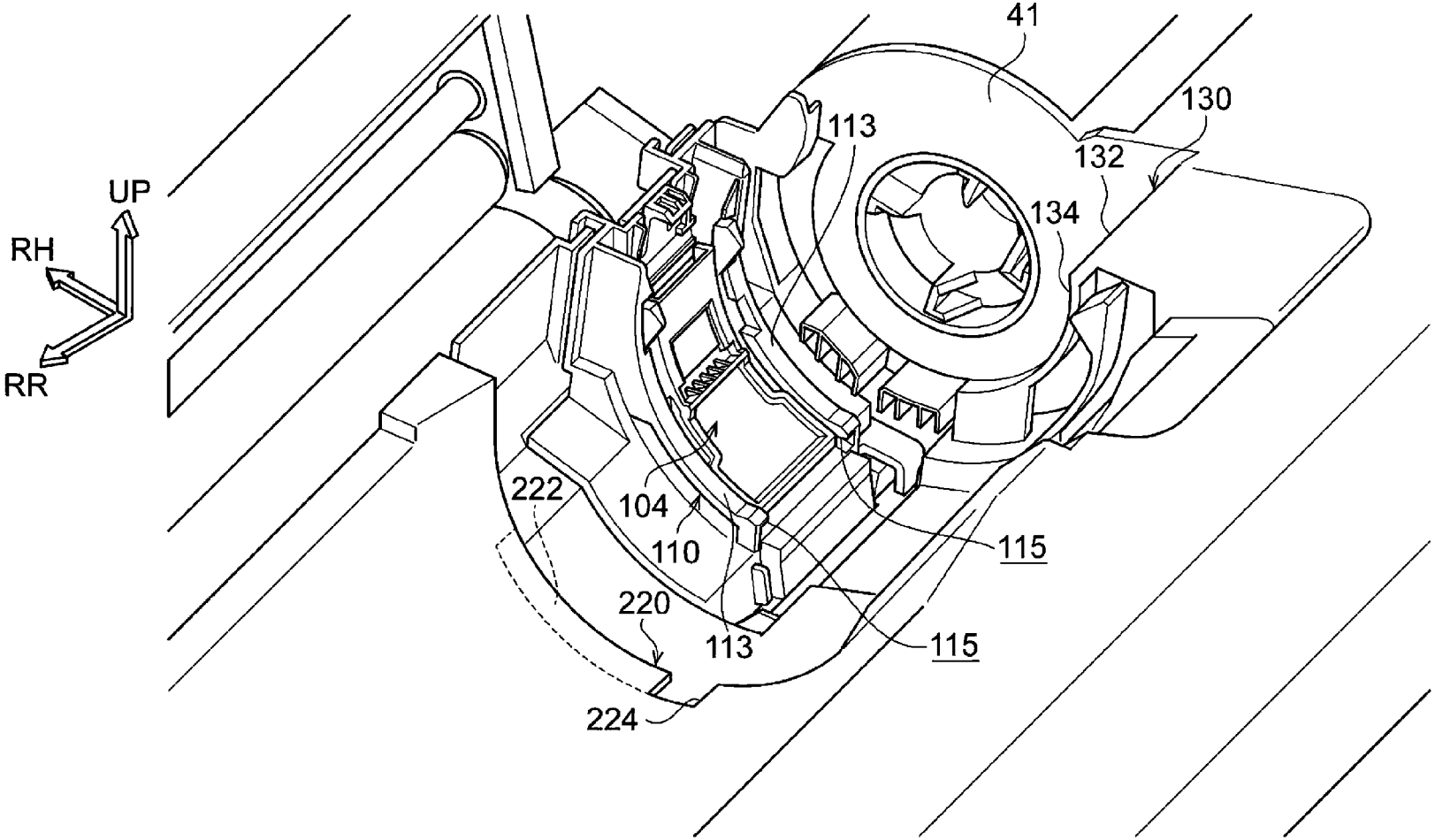
FIG. 11 is a perspective view of the image forming apparatus illustrated in FIG. 10, with an openable-closable member being closed.

As described above, the image forming unit 18 includes the photoconductor drum 20, the charging roller 24 as a charging device, the developing device 28, and the remover 27. As illustrated in FIGS. 1 and 6, the image forming unit 18 further includes a unit body 30 and a storage container 60. As illustrated in FIGS. 10 and 11, the image forming unit 18 further includes an openable-closable member 104, a supporting portion 110, a holding portion 220, and a guiding portion 130. The image forming unit 18 further includes a guiding portion 230 (see FIG. 3), and a first projection 310 and a second projection 320 (see FIGS. 21 and 22). In FIGS. 3 to 6, the first projection 310 and the second projection 320 are not illustrated.

Unit Body 30

The unit body 30 is an exemplary body. As illustrated in FIG. 1, the unit body 30 is a structure provided with elements of the image forming unit 18, such as the photoconductor drum 20, the charging roller 24, the developing device 28, and the remover 27. The unit body 30 is also regarded as a supporting body that supports the photoconductor drum 20, the charging roller 24, elements forming the developing device 28, elements forming the remover 27, and so forth.

Figure 3:
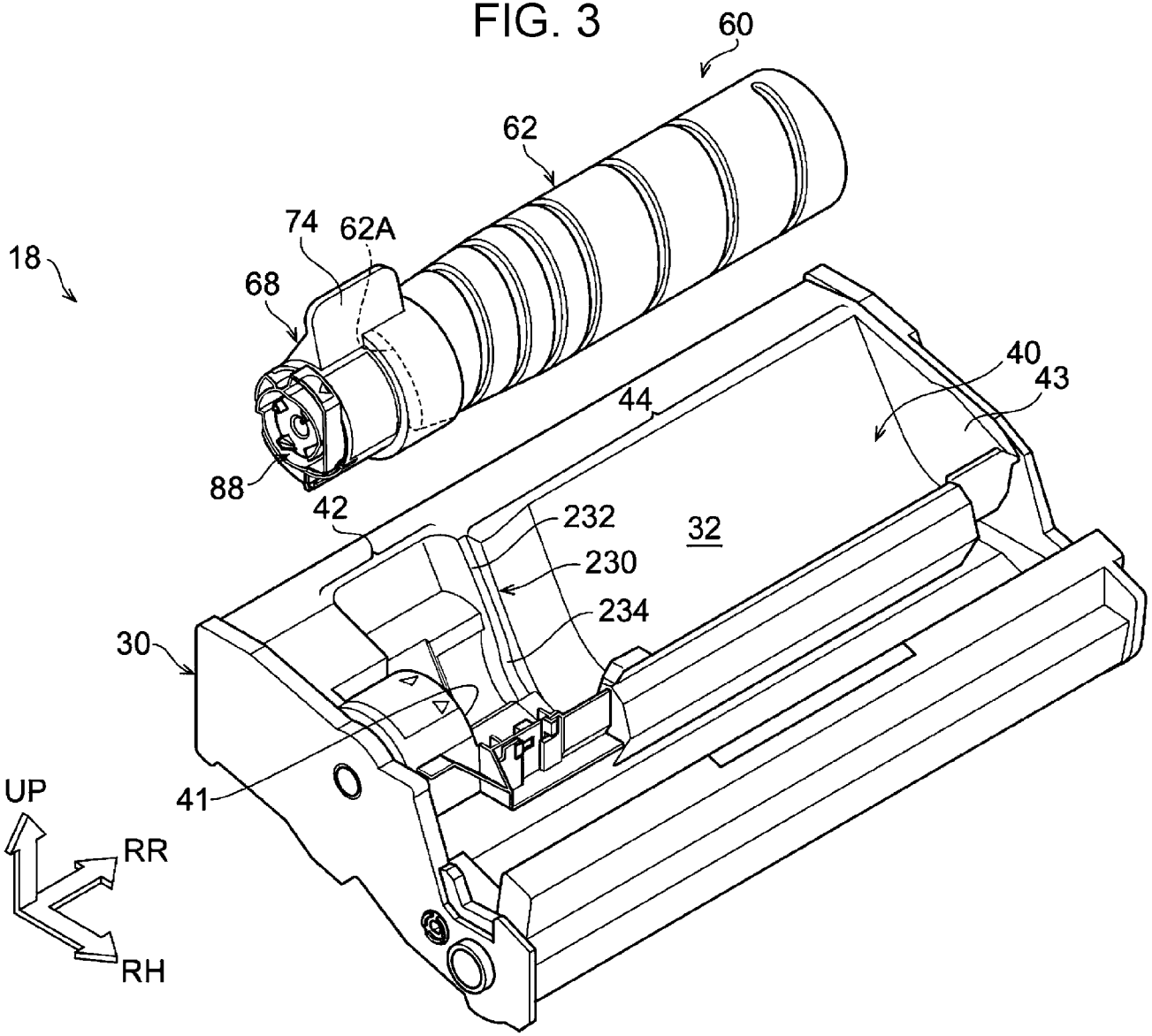
FIG. 3 is a perspective view of an image forming unit according to the exemplary embodiment.

As illustrated in FIG. 3, the unit body 30 has a placing space 32 in which the storage container 60 is to be placed. The placing space 32 is open on the upper side. The storage container 60 is placed into the placing space 32 from the upper side.

As illustrated in FIG. 3, the unit body 30 includes a wall portion 40 that defines the placing space 32. The wall portion 40 includes a front wall 41 (see FIG. 4), a rear wall 43, a front peripheral wall 42, and a rear peripheral wall 44.

The front peripheral wall 42 is positioned on the front side of the unit body 30. Specifically, the front peripheral wall 42 is a wall positioned on the front side with respect to the rear peripheral wall 44 and extending in the front-rear direction. As illustrated in FIGS. 5 and 6, the front peripheral wall 42 extends around the periphery (specifically, on the right side, the lower side, and the left side) of a lid portion 68, to be described below, of the storage container 60 placed in the placing space 32.

Figure 7:
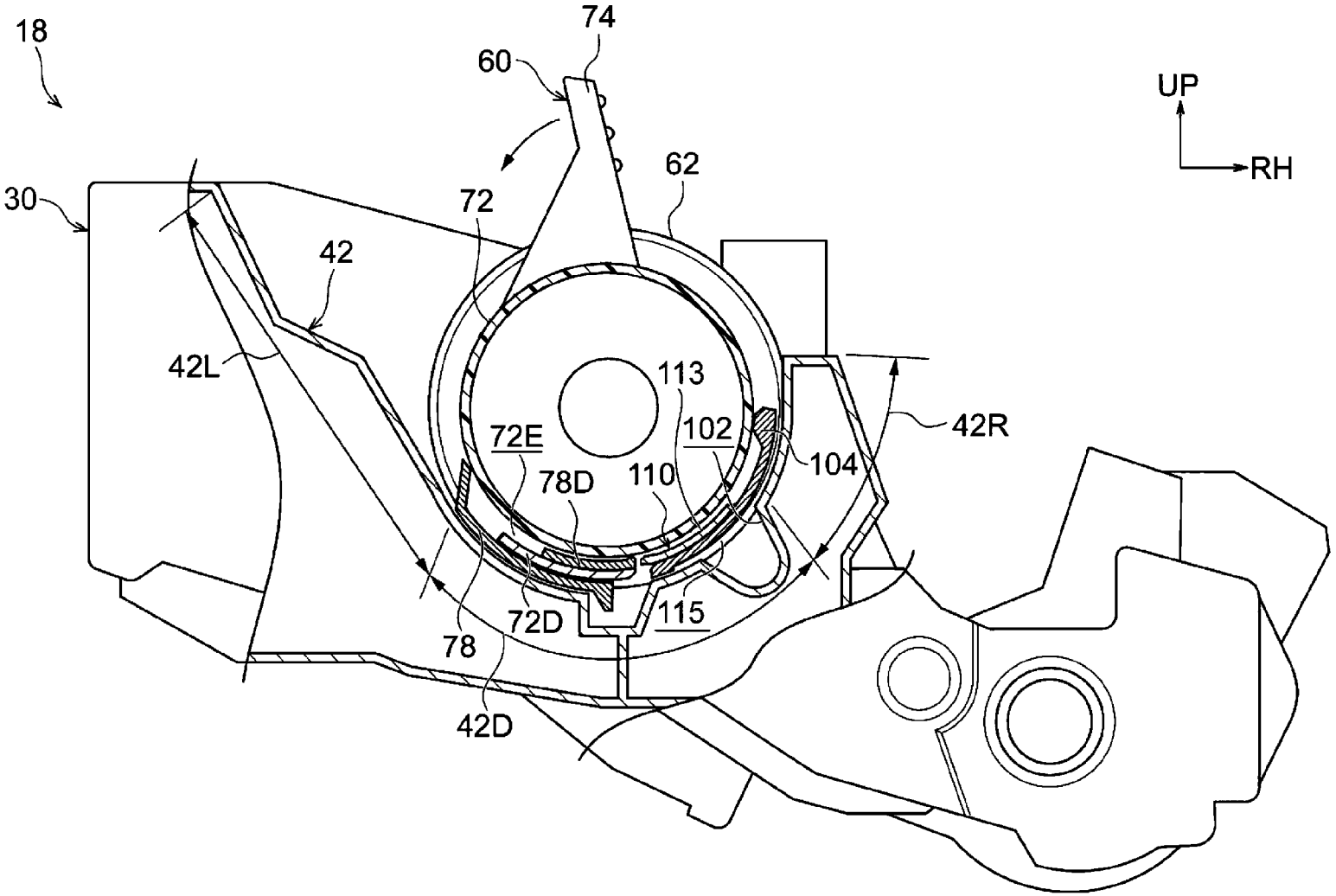
FIG. 7 is a sectional view of the image forming unit according to the exemplary embodiment, with the storage container being in the unset position.

As illustrated in FIG. 7, seen in the front-rear direction, the front peripheral wall 42 has a substantially arc shape at a bottom part 42D and at a right side part 42R. A left side part 42L of the front peripheral wall 42 extends obliquely from the bottom part 42D toward the upper left side.

As illustrated in FIG. 3, the rear peripheral wall 44 is a wall positioned on the rear side with respect to the front peripheral wall 42 and extending in the front-rear direction. The rear peripheral wall 44 extends around the periphery (specifically, on the right side, the lower side, and the left side) of a storage portion 62, to be described below, of the storage container 60 placed in the placing space 32.

Figure 9:
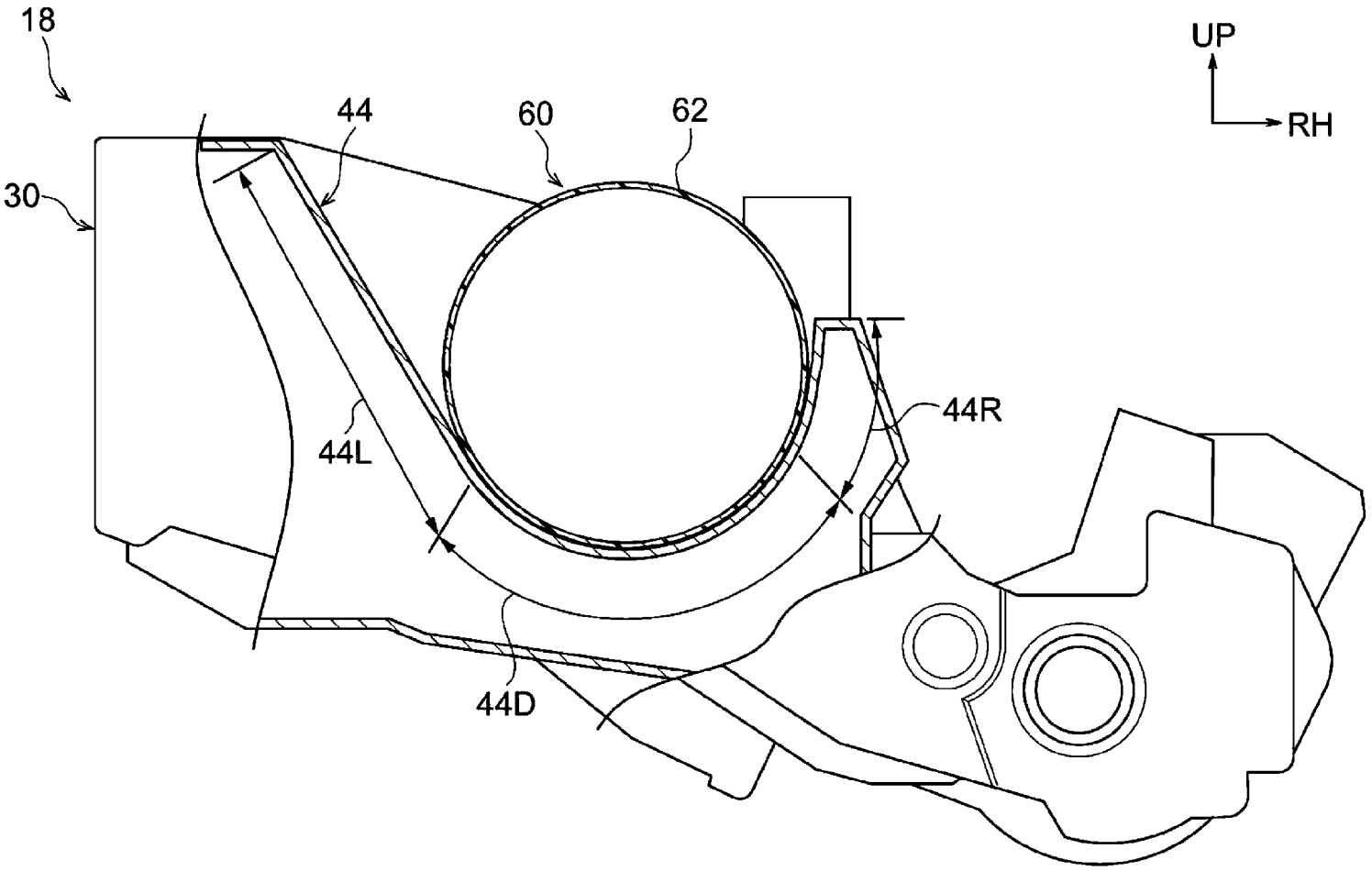
FIG. 9 is a sectional view of the image forming unit according to the exemplary embodiment, taken at a storage portion of the storage container.

As illustrated in FIG. 9, seen in the front-rear direction, the rear peripheral wall 44 has a substantially arc shape at a bottom part 44D and at a right side part 44R. A left side part 44L of the rear peripheral wall 44 extends obliquely from the bottom part 44D toward the upper left side.

The bottom part 42D of the front peripheral wall 42 and the bottom part 44D of the rear peripheral wall 44 (hereinafter collectively denoted as the bottom parts 42D and 44D) are positioned below the storage container 60 placed in the placing space 32 and are each an exemplary bottom wall. In plan view, the bottom parts 42D and 44D are each also regarded as a part behind (overlapping) the storage container 60 placed in the placing space 32.

Therefore, when the storage container 60 is in the placing space 32, the storage container 60 is positioned on the bottom parts 42D and 44D. In other words, the storage container 60 is placed on the bottom parts 42D and 44D.

The storage container 60 is placed into the placing space 32 (see FIG. 5) by bringing the storage container 60 from the upper side of the placing space 32 (see FIG. 3) toward the lower side into the placing space 32. In other words, the storage container 60 is placed on the bottom parts 42D and 44D by moving the storage container 60 in a direction from the upper side of the bottom parts 42D and 44D toward the bottom parts 42D and 44D (an approaching direction). The storage container 60 thus placed on the bottom parts 42D and 44D is then rotated counterclockwise in FIG. 7, whereby the storage container 60 is held by the supporting portion 110 and the holding portion 220 (see FIG. 10). Thus, the storage container 60 is completely set in the unit body 30 (see FIG. 6). Details of the supporting portion 110 and the holding portion 220 will be described separately below.

Figure 8:
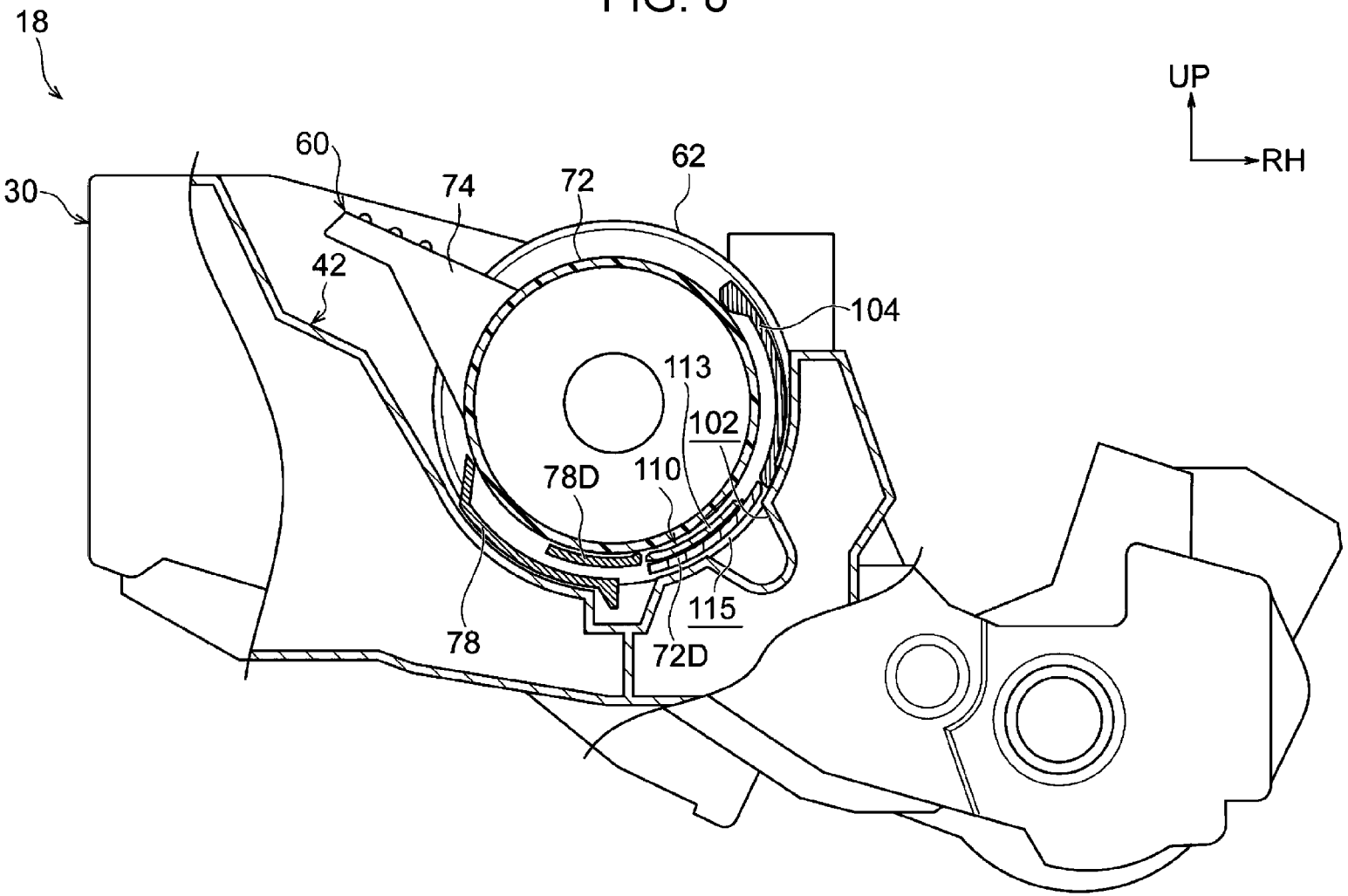
FIG. 8 is a sectional view of the image forming unit according to the exemplary embodiment, with the storage container being in the set position.

Hereinafter, the position of the storage container 60 that is placed in the placing space 32 but is not held by the supporting portion 110 and the holding portion 220 (see FIG. 10) as illustrated in FIGS. 5 and 7 is referred to as "unset position", and the position of the storage container 60 that is placed in the placing space 32 and is held by the supporting portion 110 and the holding portion 220 (see FIG. 10) as illustrated in FIGS. 6 and 8 is referred to as "set position". Furthermore, the direction of rotation from the unset position toward the set position is referred to as "setting-rotation direction", and the direction of rotation from the set position toward the unset position is referred to as "releasing-rotation direction".

The storage container 60 is attachable to and detachable from the unit body 30 in either of the following states: a state where the image forming unit 18 is set in the image-forming-apparatus body 11 (see FIG. 1), and a state where the image forming unit 18 is off the image-forming-apparatus body 11 (see FIG. 2).

As illustrated in FIGS. 7 and 10, the bottom part 42D of the front peripheral wall 42 has an inlet 102 through which the toner in the storage container 60 moves into the developing device 28 (see FIG. 1). The inlet 102 has a rectangular shape in plan view. The inlet 102 is provided with the openable-closable member 104.

Figure 12:
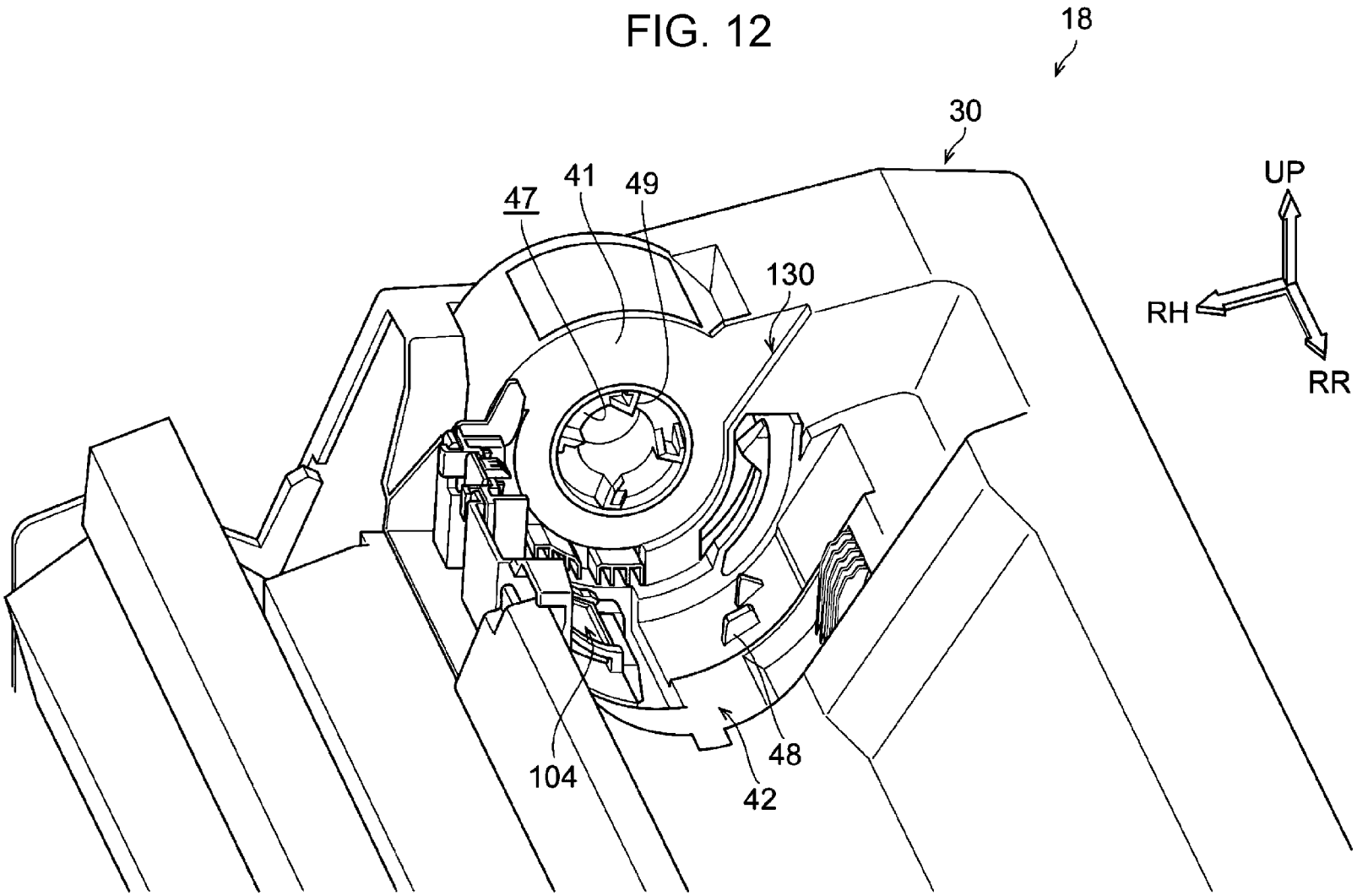
FIG. 12 is another enlarged perspective view of the image forming unit according to the exemplary embodiment, illustrating the front peripheral wall.
Figure 13:
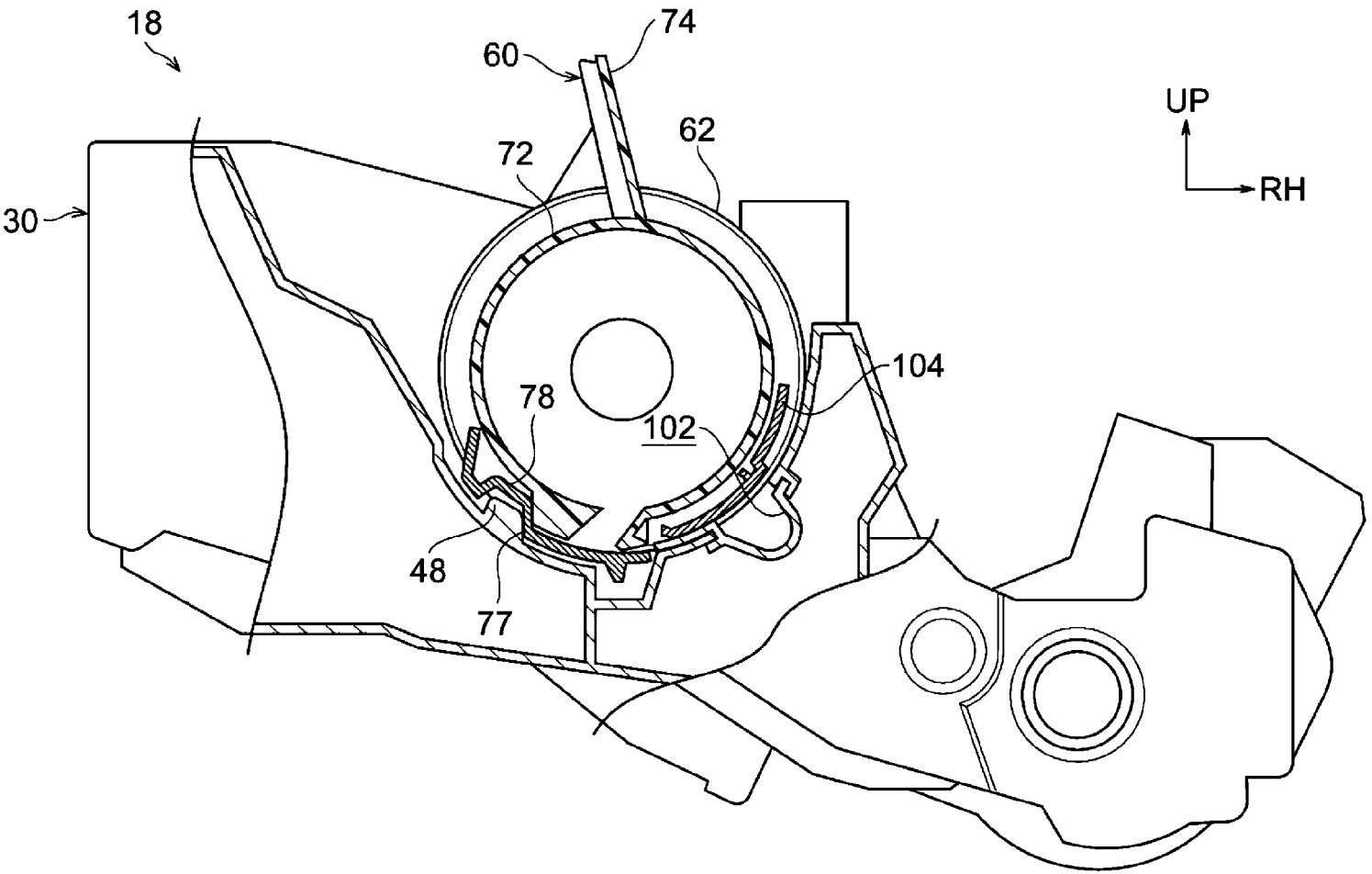
FIG. 13 is another sectional view of the image forming unit according to the exemplary embodiment, with the storage container being in the unset position.

As illustrated in FIGS. 12 and 13, the bottom part 42D of the front peripheral wall 42 has a stopper 48 that stops the movement of the openable-closable member 78. When the storage container 60 is placed to be in the unset position, the stopper 48 goes into a recess 77 provided in an openable-closable member 78, to be described below, of the storage container 60.

As illustrated in FIG. 12, the stopper 48 projects upward from the bottom part 42D of the front peripheral wall 42 and has a trapezoidal shape when seen in the front-rear direction. When the storage container 60 is placed to be in the unset position, the stopper 48 goes into the recess 77 of the below-described openable-closable member 78 and comes into contact with the inner wall of the recess 77. Thus, the stopper 48 stops the movement of the openable-closable member 78.

The rear wall 43 illustrated in FIG. 3 is an exemplary opposing wall. The rear wall 43 faces toward the front side and is opposed to a rear end surface 60R (see FIGS. 5 and 21) of the storage container 60 that is either in the unset position or in the set position.

When the storage container 60 is in the unset position or in the set position, there is a gap between the rear wall 43 and the rear end surface 60R of the storage container 60 (see FIGS. 5 and 12). Furthermore, when the storage container 60 is in the unset position or in the set position, a rear part of the storage container 60 is not bound to the unit body 30. In other words, the rear part of the storage container 60 is allowed to move away from the unit body 30. Specifically, the rear part of the storage container 60 is movable toward the upper side. That is, the storage container 60 is regarded as being supported in a cantilever manner at the front end.

Figure 4:
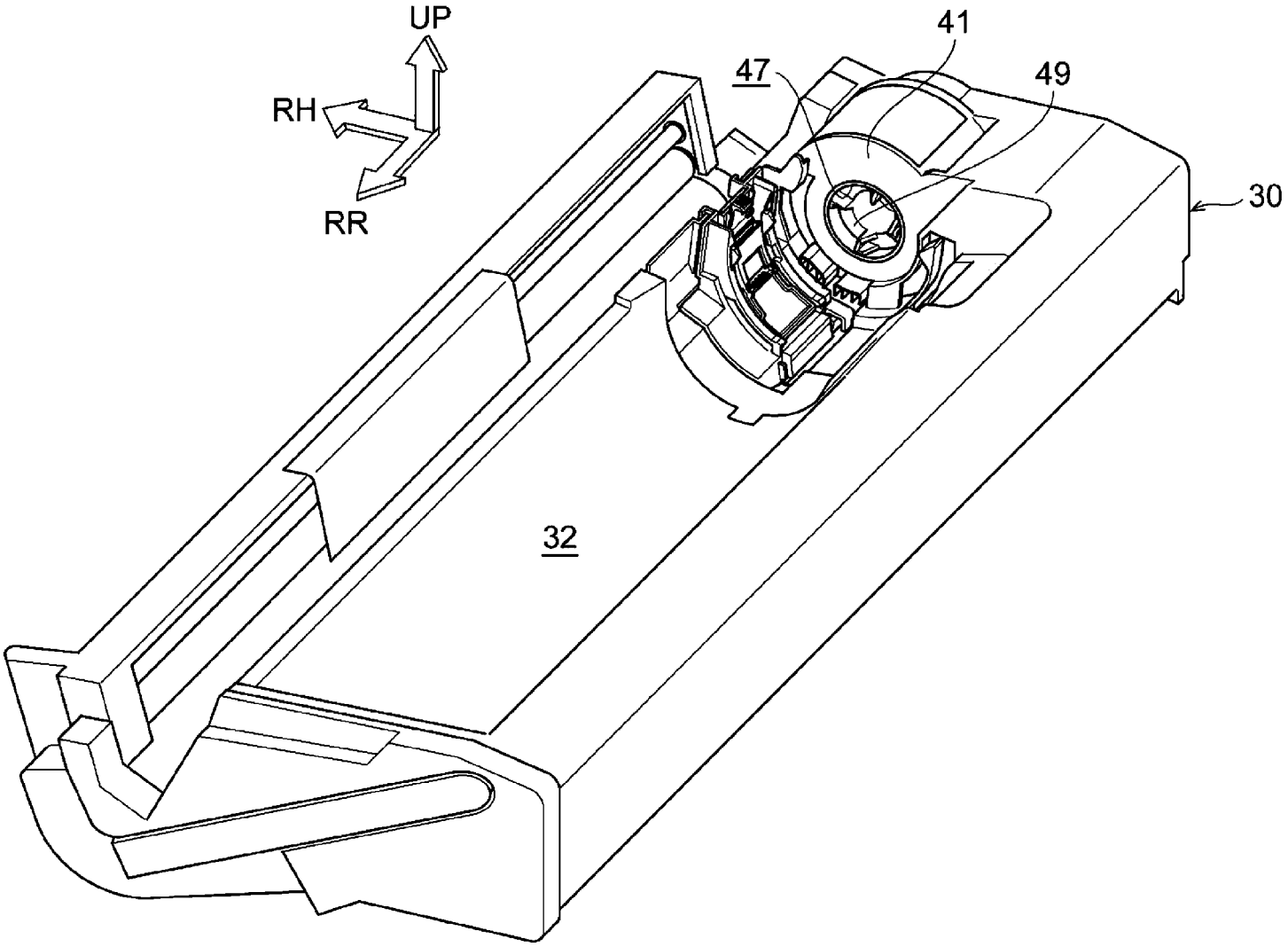
FIG. 4 is a perspective view of a unit body of the image forming unit according to the exemplary embodiment.

As illustrated in FIG. 4, the front wall 41 is a wall facing toward the rear side. The front wall 41 has a circular hole 47. A transmitting portion 49 is provided in the circular hole 47. The transmitting portion 49 is connected to a transmitting portion 88, to be described below, of the storage container 60. Specifically, the transmitting portion 49 is a coupling that meshes with the below-described transmitting portion 88 of the storage container 60 in the front-rear direction.

Storage Container 60

The storage container 60 illustrated in FIGS. 3 and 5 is an exemplary holding object. The storage container 60 is a container in which toner is stored. Specifically, the toner stored in the storage container 60 is to be supplied to the developing device 28. In other words, the storage container 60 stores toner yet to be used, i.e., fresh toner.

As illustrated in FIGS. 3 and 5, the storage container 60 is elongated in the front-rear direction (an exemplary one direction). Specifically, as illustrated in FIG. 3, the storage container 60 includes the storage portion 62, the lid portion 68, the openable-closable member 78 (see FIG. 14), and the transmitting portion 88.

Figure 14:
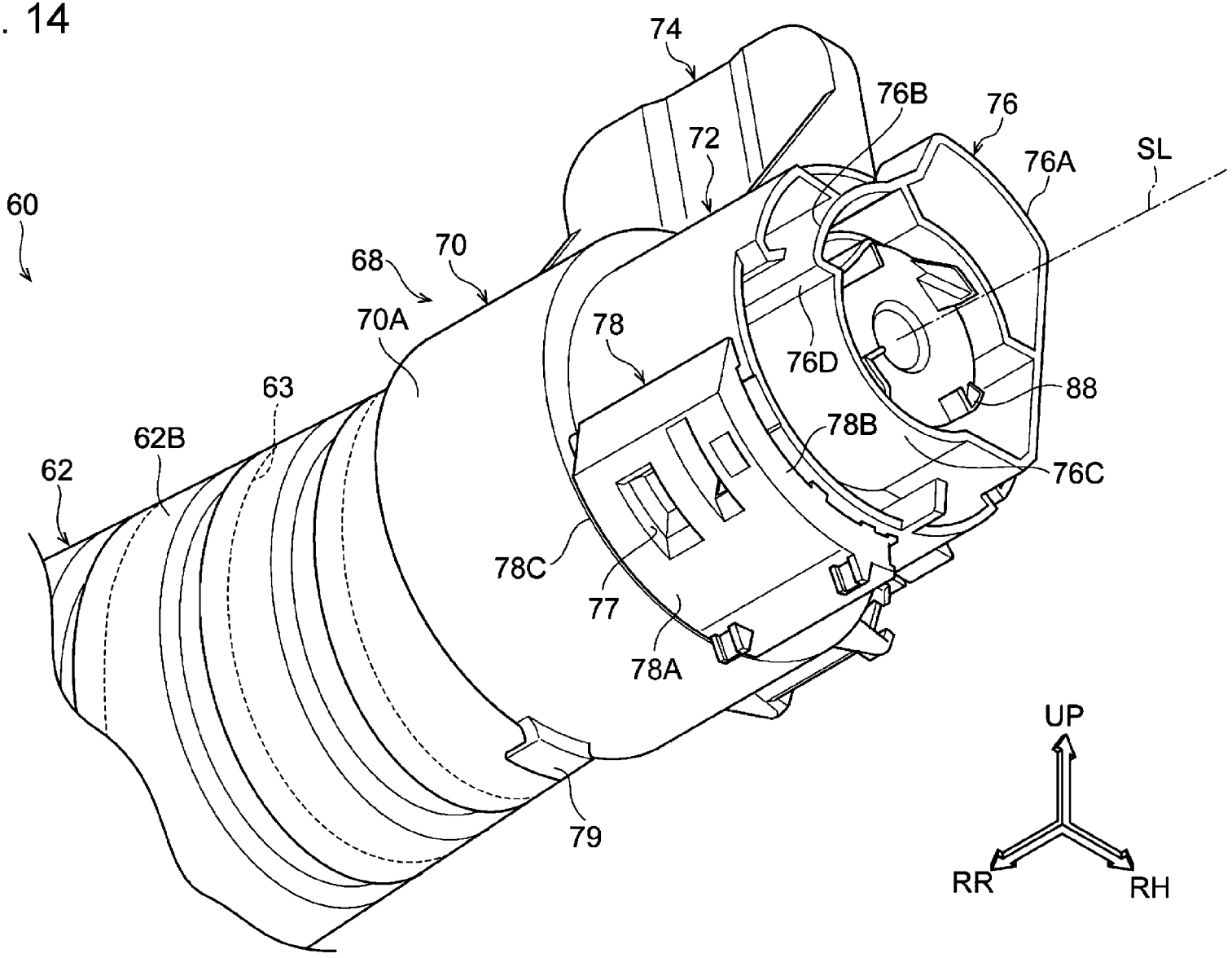
FIG. 14 is an enlarged perspective view of the storage container according to the exemplary embodiment.
Figure 15:
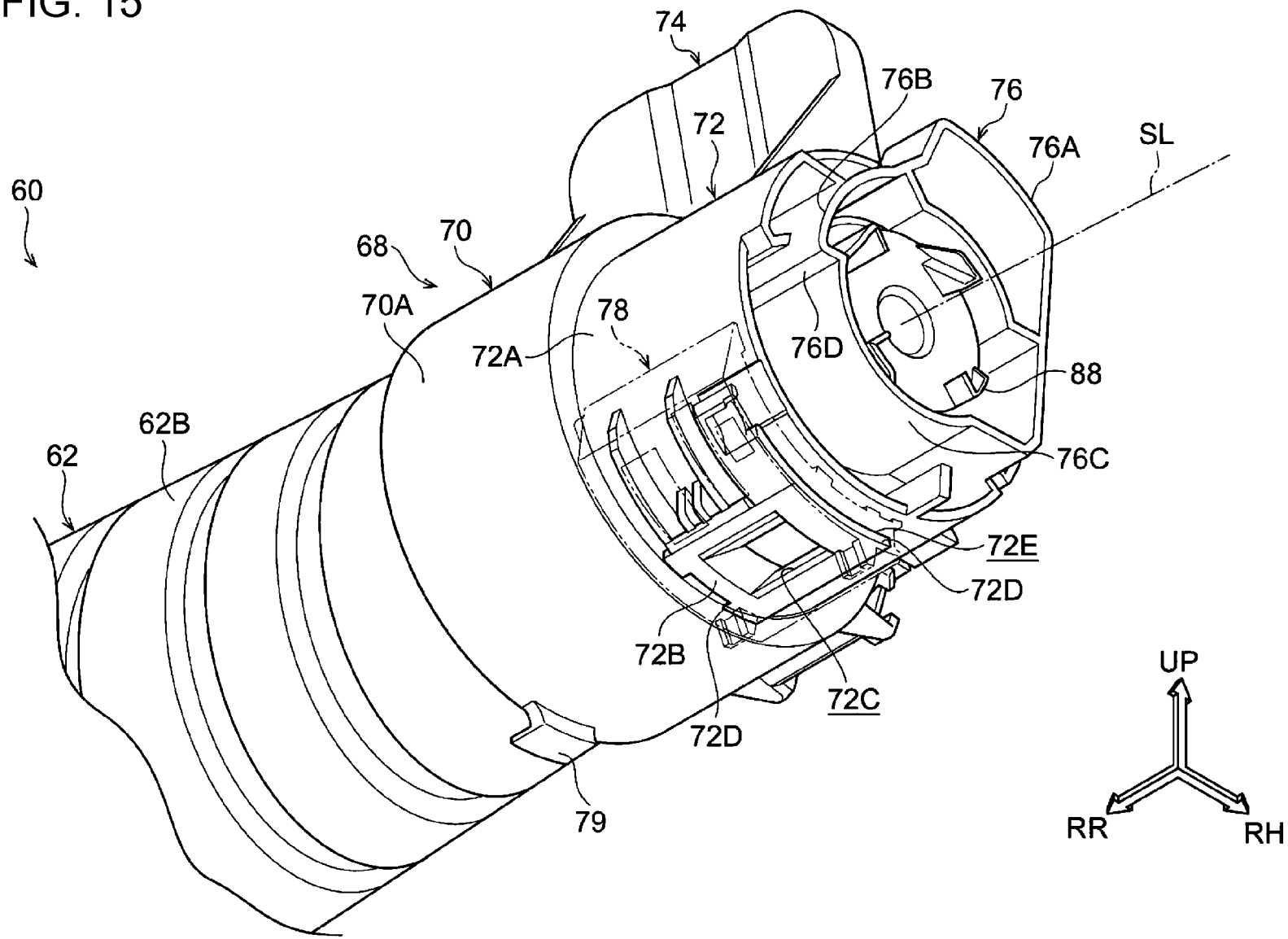
FIG. 15 is another enlarged perspective view of the storage container according to the exemplary embodiment.
Figure 16:
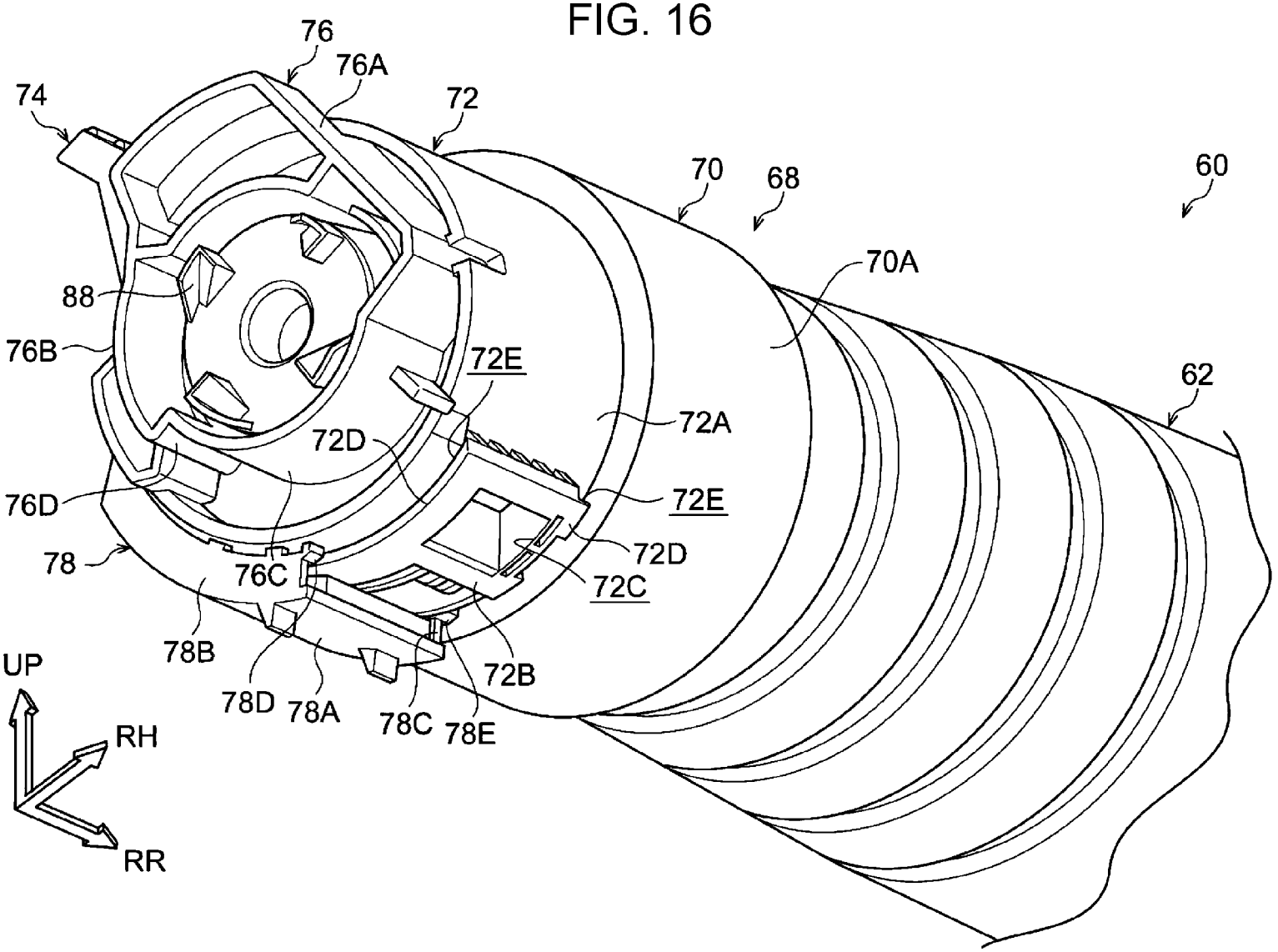
FIG. 16 is yet another enlarged perspective view of the storage container according to the exemplary embodiment.

The lid portion 68 has an outlet 72C (see FIGS. 15 and 16) from which the toner is discharged to the outside. The outlet 72C is opened and closed by the openable-closable member 78 illustrated in FIG. 14. FIGS. 14 and 15 illustrate the storage container 60 that is in an orientation corresponding to the unset position. FIG. 16 illustrates the storage container 60 that is in an orientation corresponding to the set position.

Storage Portion 62

The storage portion 62 illustrated in FIGS. 3 and 14 is an exemplary rotating portion. The storage portion 62 is a portion of the storage container 60 in which toner is stored. The storage portion 62 is integrally molded from a resin material. Specifically, the storage portion 62 extends in the front-rear direction. More specifically, the storage portion 62 has a substantially cylindrical bottomed shape with a closed rear end and an axis extending in the front-rear direction. In other words, the storage portion 62 has a cylindrical outer peripheral surface. Furthermore, the diameter of a front part of the storage portion 62 is gradually reduced toward the front side. As illustrated in FIG. 3, the storage portion 62 has a mouth part 62A at the front end.

As illustrated in FIG. 14, the storage portion 62 has a helical ridge 63 provided on the inner surface of a peripheral wall 62B and projecting inward. In the storage container 60, when the storage portion 62 rotates in the peripheral direction thereof, the toner stored in the storage portion 62 is transported by the helical ridge 63 from the rear side toward the front side. That is, the toner stored in the storage portion 62 moves toward the lid portion 68.

Lid Portion 68

The lid portion 68 illustrated in FIGS. 14 and 15 is an exemplary supporting portion. As illustrated in FIG. 3, the lid portion 68 has a function of closing the mouth part 62A of the storage portion 62. The lid portion 68 supports, at the rear end thereof, the front end of the storage portion 62 such that the storage portion 62 is rotatable on an axis extending in the front-rear direction. The lid portion 68 is integrally molded from a resin material. The lid portion 68 has a substantially cylindrical bottomed shape with an open rear end and a closed front end. The inside of the lid portion 68 communicates with the inside of the storage portion 62 through the mouth part 62A of the storage portion 62. Hence, the toner in the storage portion 62 that is moved toward the lid portion 68 further moves into the lid portion 68 through the mouth part 62A.

As illustrated in FIGS. 14 and 15, the lid portion 68 includes a first cylinder 70, a second cylinder 72, an operated part 74, and an end part 76. The first cylinder 70, the second cylinder 72, and the end part 76 are aligned in the front-rear direction.

First Cylinder 70 and Second Cylinder 72

As illustrated in FIGS. 14 and 15, the first cylinder 70 and the second cylinder 72 are aligned in that order from the rear side toward the front side. The first cylinder 70 has a larger diameter than the second cylinder 72. The front end of the storage portion 62 is fitted in the first cylinder 70.

The first cylinder 70 has an extended part 79 extending from the rear end of the first cylinder 70 toward the outer side in the radial direction of the first cylinder 70 and then turning toward the rear side. The extended part 79 serves as a holding part to be held by the holding portion 220 (see FIG. 10, and details will be described separately below).

Figure 17:
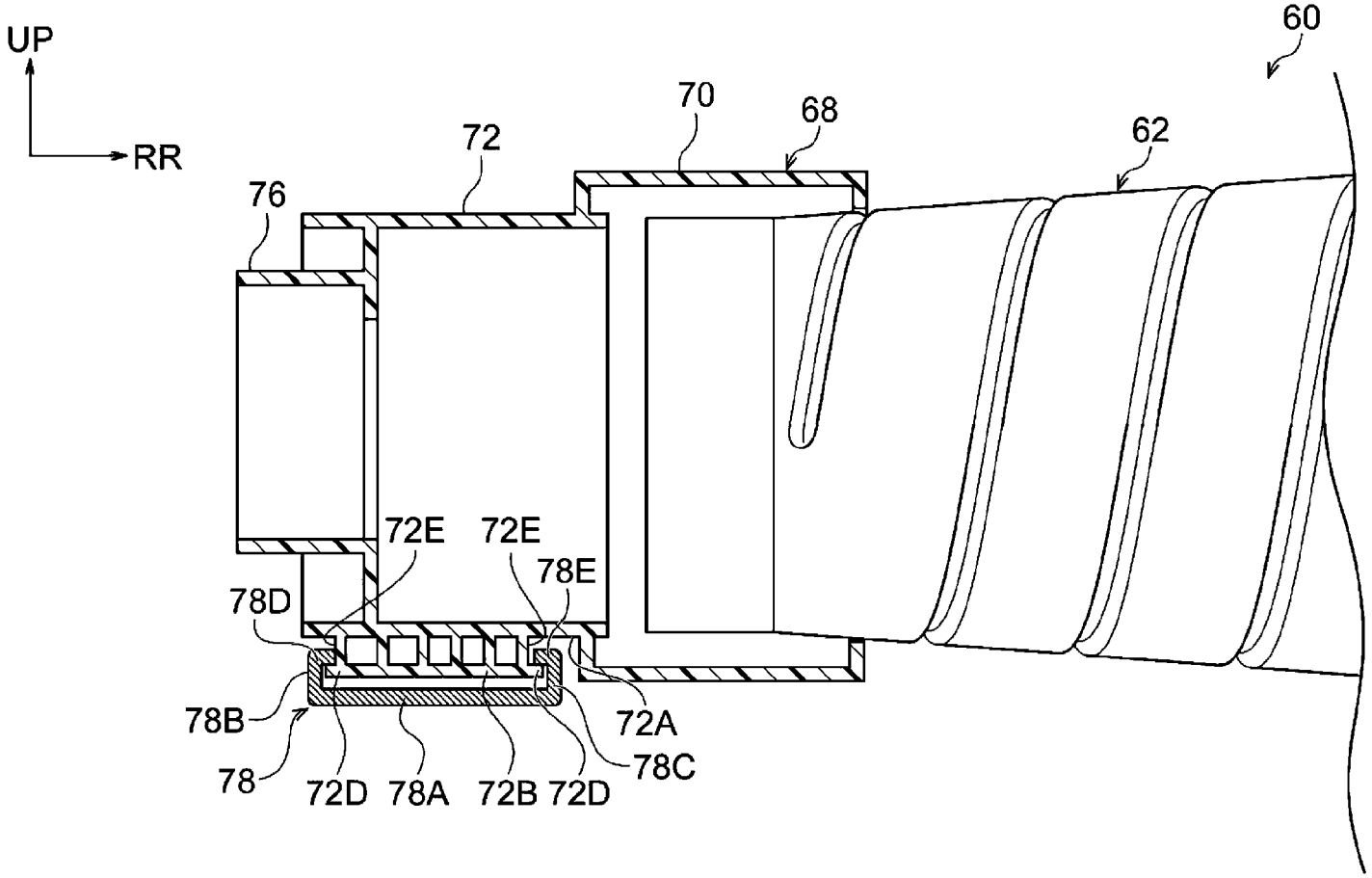
FIG. 17 is an enlarged side sectional view of the storage container according to the exemplary embodiment.

As illustrated in FIGS. 16 and 17, the second cylinder 72 includes a raised part 72B raised from a part of an outer peripheral surface 72A toward the outer side in the radial direction. Seen in the front-rear direction (the axial direction of the second cylinder 72), the raised part 72B has an arc shape conforming to the part of the outer peripheral surface 72A of the second cylinder 72.

The raised part 72B has the outlet 72C. The outlet 72C has a rectangular shape. The outlet 72C connects the inside and the outside of the lid portion 68 to each other. Therefore, the toner moving from the inside of the storage portion 62 to the inside of the lid portion 68 is allowed to move further to the outside of the lid portion 68 through the outlet 72C.

As illustrated in FIGS. 16 and 17, the raised part 72B is provided with the openable-closable member 78. That is, the raised part 72B is regarded as a fitting part to which the openable-closable member 78 is fitted. When the storage container 60 is in the unset position, the outlet 72C faces downward.

As illustrated in FIGS. 16 and 17, the raised part 72B includes guiding protrusions 72D that guide the openable-closable member 78. The guiding protrusions 72D are provided at the front and rear end surfaces, respectively, of the raised part 72B and each extend in the peripheral direction of the second cylinder 72. The raised part 72B further has guiding grooves 72E that guide the openable-closable member 78. The guiding grooves 72E are each provided between a corresponding one of the guiding protrusions 72D and the outer peripheral surface 72A of the second cylinder 72 and each extend in the peripheral direction of the second cylinder 72. Details of the openable-closable member 78 will be described separately below.

Operated Portion 74

The operated portion 74 illustrated in FIGS. 14 and 15 is operated by a worker (an operator) in a placing operation in which the storage container 60 is placed into the placing space 32 or in a setting operation in which the storage container 60 is set in the unit body 30. Specifically, for example, in the placing operation in which the storage container 60 is placed to be in the unset position, the operated portion 74 is gripped by the worker (the operator). Furthermore, in the rotating operation (the setting operation) in which the storage container 60 in the unset position is rotated to be in the set position, the operated portion 74 is pushed by the worker (the operator).

As illustrated in FIG. 3, the operated portion 74 projects from the first cylinder 70 and the second cylinder 72 toward the outer side in the radial direction of the first cylinder 70. The operated portion 74 has a plate shape with a certain thickness in the peripheral direction of the first cylinder 70.

End Part 76

As illustrated in FIGS. 14 and 15, the end part 76 is positioned on the front side with respect to the second cylinder 72. Specifically, the end part 76 forms a front end of the lid portion 68.

The end part 76 has a cylindrical shape. Specifically, the end part 76 has an outer peripheral surface 76A surrounding an axis SL of the lid portion 68 that extends in the front-rear direction. The outer peripheral surface 76A includes flat parts and curved parts.

The outer peripheral surface 76A includes a first arc surface 76B having a smaller outside diameter than the second cylinder 72 and extending in the peripheral direction of the second cylinder 72, and a second arc surface 76C having a smaller outside diameter than the first arc surface 76B and extending in the peripheral direction of the second cylinder 72. The outer peripheral surface 76A further includes a connecting surface 76D connecting the first arc surface 76B and the second arc surface 76C to each other and extending in the radial direction (see FIG. 19).

Openable-Closable Member 78

The openable-closable member 78 is fitted to the lid portion 68 in such a manner as to be movable in the peripheral direction of the lid portion 68. Specifically, the openable-closable member 78 is fitted to the raised part 72B in such a manner as to be movable with respect to the lid portion 68 between an open position (see FIG. 16) at which the outlet 72C provided in the raised part 72B of the lid portion 68 is open and a closed position (see FIG. 14) at which the outlet 72C is closed. As illustrated in FIG. 14, the openable-closable member 78 has a substantially rectangular shape when seen from the outer side in the radial direction of the lid portion 68.

As illustrated in FIGS. 14 and 17, the openable-closable member 78 includes a curved plate 78A and side plates 78B and 78C. The curved plate 78A curves along the outer peripheral surface of the raised part 72B. The side plate 78B extends from the front end of the curved plate 78A toward the outer peripheral surface of the second cylinder 72 and along the front end surface of the raised part 72B. The side plate 78B has a protrusion 78D protruding toward the rear side in such a manner as to be positioned in a corresponding one of the guiding grooves 72E.

The side plate 78C extends from the rear end of the curved plate 78A toward the outer peripheral surface of the second cylinder 72 and along the rear end surface of the raised part 72B. The side plate 78C has a protrusion 78E protruding toward the front side in such a manner as to be positioned in the other guiding groove 72E.

The protrusions 78D and 78E are positioned in the two guiding grooves 72E, respectively, whereby the openable-closable member 78 is fitted to the raised part 72B while being movable with respect to the lid portion 68 between the open position (see FIG. 16) and the closed position (see FIG. 14).

As illustrated in FIG. 14, the outer peripheral surface of the curved plate 78A has the recess 77 that receives the stopper 48 described above.

Transmitting Portion 88

The transmitting portion 88 illustrated in FIGS. 14 and 15 transmits a driving force generated by a drive unit (not illustrated) to the storage portion 62. The transmitting portion 88 is connected to the storage portion 62 inside the lid portion 68. Specifically, the transmitting portion 88 is a coupling that meshes with the transmitting portion 49 (see FIG. 4) in the front-rear direction.

In the present exemplary embodiment, when the storage container 60 in the unset position is rotated to be in the set position, a moving mechanism (not illustrated) moves the transmitting portion 49 toward the rear side and causes the transmitting portion 49 to project from the circular hole 47. Thus, the transmitting portion 49 is connected to the transmitting portion 88 of the storage container 60. Then, the driving force generated by the drive unit (not illustrated) is transmitted to the storage portion 62 through the transmitting portion 49 and the transmitting portion 88. Consequently, while the lid portion 68 is prevented from rotating, the storage portion 62 rotates on the axis extending in the front-rear direction.

When the storage container 60 is rotated from the set position to the unset position, the moving mechanism (not illustrated) moves the transmitting portion 49 toward the front side, whereby the transmitting portion 49 is disconnected from the transmitting portion 88. The lid portion 68 is provided with a sealing member (not illustrated) that suppresses toner leakage from a gap between the transmitting portion 88 and the end part 76.

Openable-Closable Member 104 and Supporting Portion 110

The openable-closable member 104 illustrated in FIGS. 10 and 11 opens and closes the inlet 102 provided in the bottom part 42D of the front peripheral wall 42 (see FIG. 7). The openable-closable member 104 has an arc shape extending along the bottom part 42D of the front peripheral wall 42 and has a rectangular shape in plan view. The openable-closable member 104 is provided over the inlet 102.

The supporting portion 110 has a function of supporting the openable-closable member 104 such that the openable-closable member 104 is openable and closable. Specifically, as illustrated in FIGS. 10 and 11, the supporting portion 110 includes a pair of supporting members 113 provided on the front side and the rear side, respectively, of the inlet 102. The pair of supporting members 113 each project upward from the bottom part 42D of the front peripheral wall 42 and extend in the peripheral direction of the front peripheral wall 42. The pair of supporting members 113 face each other in the front-rear direction. The pair of supporting members 113 have respective guiding grooves 115 whose open sides face each other. The pair of guiding grooves 115 are each defined between a corresponding one of the supporting members 113 and the front peripheral wall 42. The front end and the rear end of the openable-closable member 104 are fitted in the pair of guiding grooves 115, respectively, whereby the openable-closable member 104 is openably and closably supported by the pair of supporting members 113.

Specifically, when the openable-closable member 104 is at an initial position (in a state where the storage container 60 is yet to be placed in the placing space 32), the openable-closable member 104 is at the closed position (see FIGS. 7 and 11) at which the inlet 102 is closed. In this state, the openable-closable member 104 is movable toward the open position (see FIGS. 8 and 10) at which the inlet 102 is open.

When the storage container 60 is in the unset position, the pair of supporting members 113 are positioned on the downstream side in the setting-rotation direction with respect to the raised part 72B. Specifically, the pair of supporting members 113 are positioned such that the pair of guiding protrusions 72D (see FIGS. 16 and 17) of the raised part 72B of the storage container 60 that is being rotated from the unset position to the set position go into the pair of guiding grooves 115, respectively (see FIG. 7).

As illustrated in FIG. 8, when the storage container 60 that is in the unset position is rotated in the setting-rotation direction toward the set position, the pair of guiding protrusions 72D of the raised part 72B of the storage container 60 go into the pair of guiding grooves 115. When the storage container 60 is further rotated in the setting-rotation direction toward the set position, the right end surface of the raised part 72B of the storage container 60 pushes the openable-closable member 104 in the setting-rotation direction, whereby the openable-closable member 104 is moved from the closed position to the open position.

On the other hand, when the storage container 60 that is in the set position is rotated in the releasing-rotation direction toward the unset position, a protrusion (not illustrated) provided on the lid portion 68 pushes the openable-closable member 104 in the releasing-rotation direction and moves the openable-closable member 104 from the open position to the closed position.

As described above, when the pair of guiding protrusions 72D go into the pair of guiding grooves 115, the raised part 72B of the lid portion 68 of the storage container 60 is held by the supporting members 113. That is, the front end of the lid portion 68 is held by the pair of supporting members 113. Specifically, the pair of supporting members 113 stop the movement of the lid portion 68 in a direction away from the bottom part 42D of the front peripheral wall 42. That is, the pair of supporting members 113 prevent the lid portion 68 from moving upward.

As described above, the pair of supporting members 113 have a function of holding the front end of the lid portion 68. That is, the pair of supporting members 113 serves as an exemplary first holding portion.

Holding Portion 220

The holding portion 220 is an exemplary second holding portion. As illustrated in FIG. 10, the holding portion 220 is provided at the front end of the rear peripheral wall 44.

Figure 18:
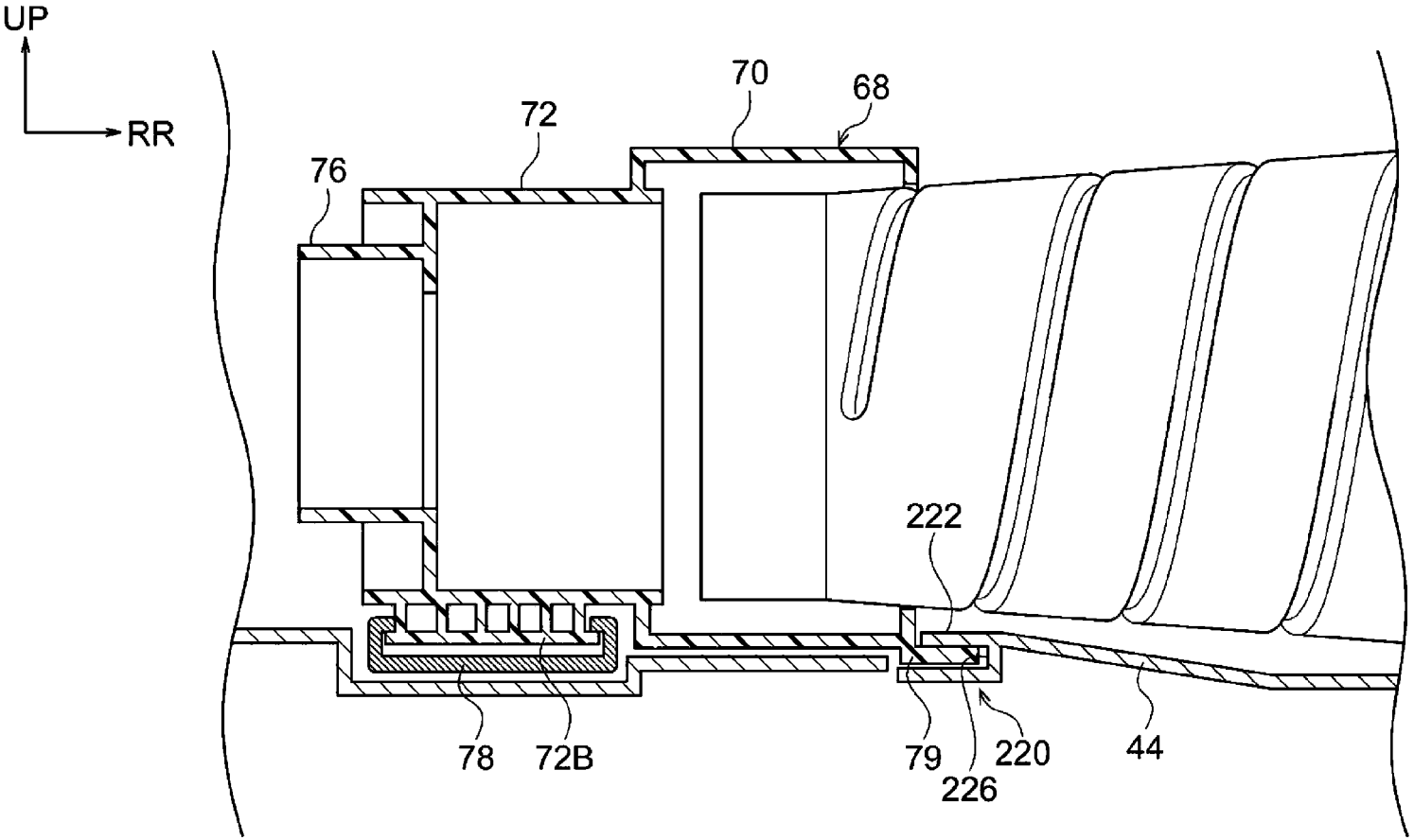
FIG. 18 is a side sectional view of a holding portion according to the exemplary embodiment.

The holding portion 220 has a notch 224 and a guiding protrusion 222 (see FIG. 18). The guiding protrusion 222 protrudes from the front end of the rear peripheral wall 44 toward the front side as illustrated in FIG. 18 and extends in the peripheral direction of the rear peripheral wall 44 as illustrated in FIG. 10. As illustrated in FIG. 18, a guiding groove 226 is provided between the guiding protrusion 222 and the rear peripheral wall 44 and extends in the peripheral direction of the rear peripheral wall 44.

The notch 224 is a space in which the extended part 79 of the storage container 60 that is in the unset position is positioned. The notch 224 is provided at the upstream end of the guiding protrusion 222 in the setting-rotation direction.

When the storage container 60 is in the unset position, the extended part 79 is positioned in the notch 224 of the holding portion 220. When the storage container 60 is rotated from the unset position to the set position, the extended part 79 moves along the guiding groove 226.

Thus, the rear end of the lid portion 68 of the storage container 60 is held by the holding portion 220. Specifically, the holding portion 220 stops the movement of the lid portion 68 in a direction away from the bottom part 44D of the rear peripheral wall 44. That is, the holding portion 220 prevents the lid portion 68 from moving upward.

Guiding Portion 130

The guiding portion 130 illustrated in FIG. 10 is an exemplary first guiding portion. The guiding portion 130 has a function of guiding the outer peripheral surface 76A (see FIGS. 14 and 15) of the end part 76 of the storage container 60 in a direction toward the lower right side (an exemplary approaching direction). The guiding portion 130 is continuous with the front wall 41 on the rear side of the front wall 41.

Figure 19:
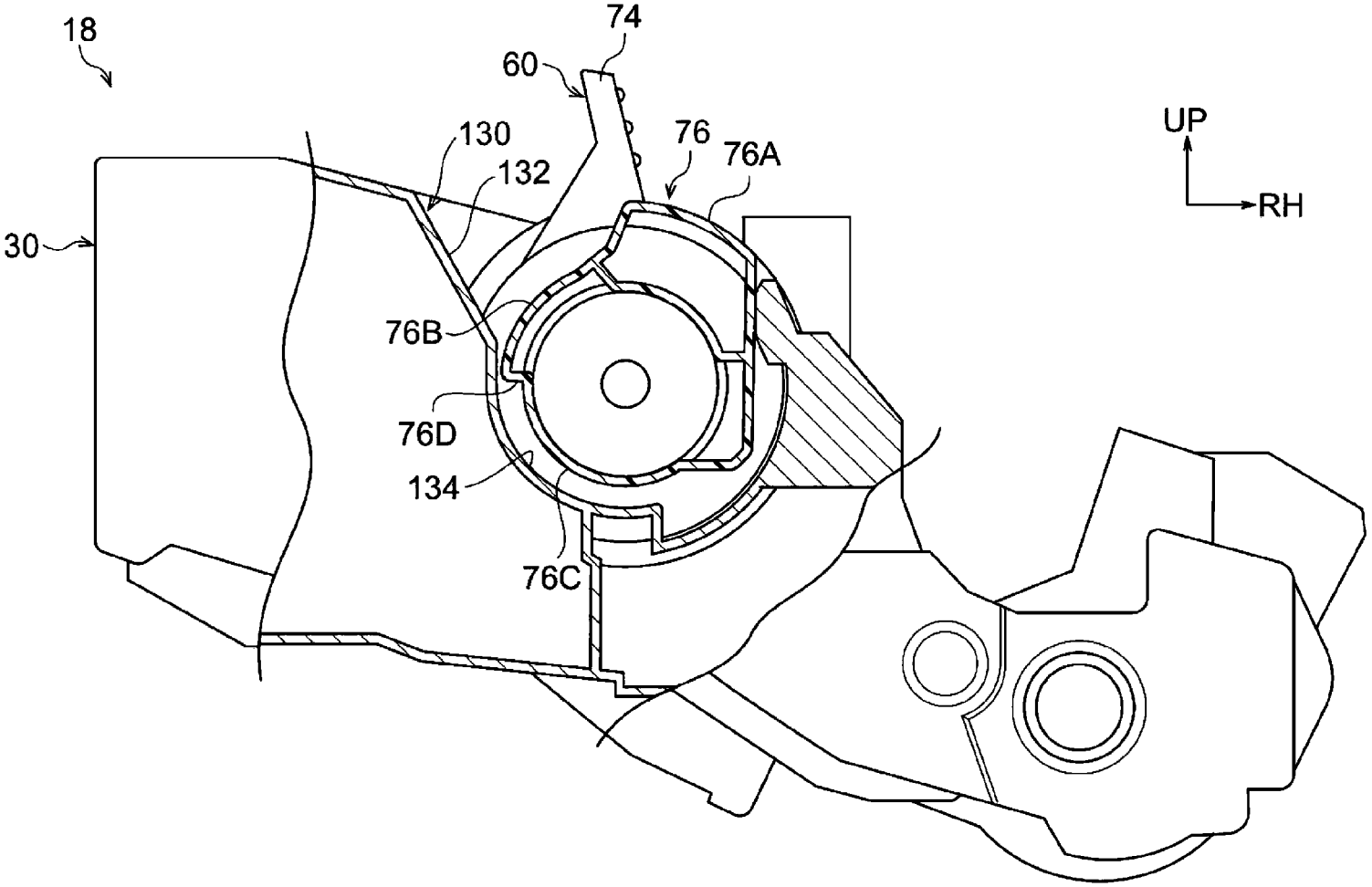
FIG. 19 is a sectional view of the image forming unit according to the exemplary embodiment, illustrating a guiding portion.

Specifically, as illustrated in FIGS. 10 and 19, the guiding portion 130 includes a sloping surface 132 and an arc surface 134. The sloping surface 132 is an exemplary first surface. The arc surface 134 is an exemplary second surface.

The sloping surface 132 forms a descending slope extending toward lower right side. The arc surface 134 is continuous with the sloping surface 132 and curves downward from the lower end of the sloping surface 132. In other words, the arc surface 134 forms a descending slope sloping from the lower end of the sloping surface 132 toward the lower right side and at an angle greater than the angle of the descending slope formed of the sloping surface 132. The sloping surface 132 and the arc surface 134 each form a surface extending from the front wall 41 toward the rear side.

The sloping surface 132 and the arc surface 134 guide the outer peripheral surface 76A of the end part 76 of the lid portion 68 placed in the placing space 32. Specifically, the sloping surface 132 and the arc surface 134 guide the lid portion 68 while being in contact with, for example, the first arc surface 76B, the second arc surface 76C, the connecting surface 76D, and so forth included in the outer peripheral surface 76A of the end part 76.

Guiding Portion 230

The guiding portion 230 illustrated in FIG. 3 is an exemplary second guiding portion. The guiding portion 230 has a function of guiding an outer peripheral surface 70A (see FIGS. 14 and 15) of the first cylinder 70 of the storage container 60 in a direction toward the lower right side (an exemplary approaching direction). The guiding portion 230 is continuous with the rear peripheral wall 44 on the front side of the rear peripheral wall 44. In other words, the guiding portion 230 is provided at the front end of the rear peripheral wall 44.

Figure 20:
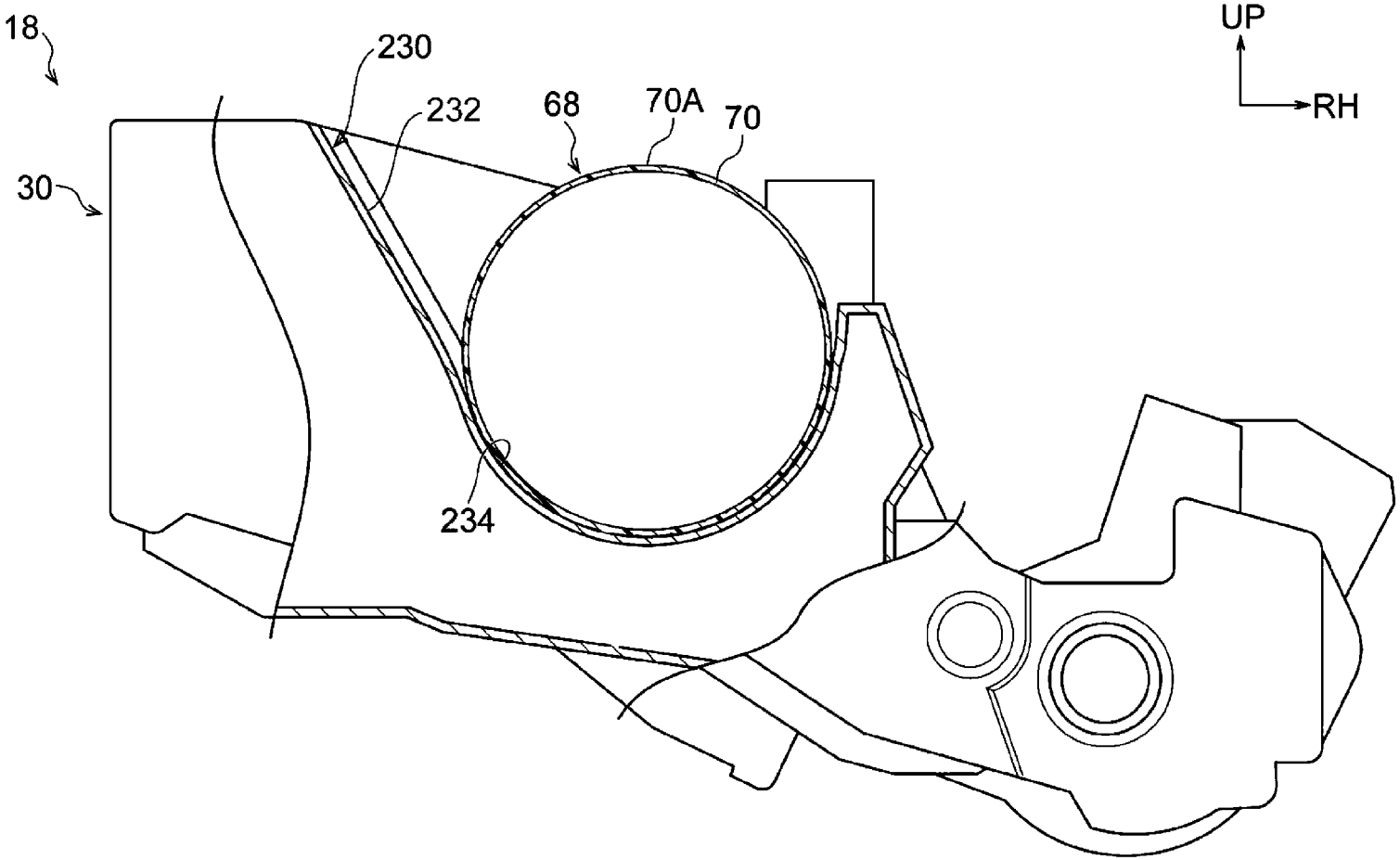
FIG. 20 is another sectional view of the image forming unit according to the exemplary embodiment, illustrating the guiding portion.

As illustrated in FIGS. 3 and 20, the guiding portion 230 includes a sloping surface 232 and an arc surface 234. The sloping surface 232 is an exemplary first surface. The arc surface 234 is an exemplary second surface.

The sloping surface 232 forms a descending slope extending toward the lower right side. The arc surface 234 is continuous with the sloping surface 232 and curves downward from the lower end of the sloping surface 232. In other words, the arc surface 234 forms a descending slope sloping from the lower end of the sloping surface 232 toward the lower right side and at an angle greater than the angle of the descending slope formed of the sloping surface 232.

The sloping surface 232 and the arc surface 234 guide the lid portion 68 while being in contact with the outer peripheral surface 70A at the rear end of the first cylinder 70 of the lid portion 68 placed in the placing space 32.

First Projection 310 and Second Projection 320

Figure 21:
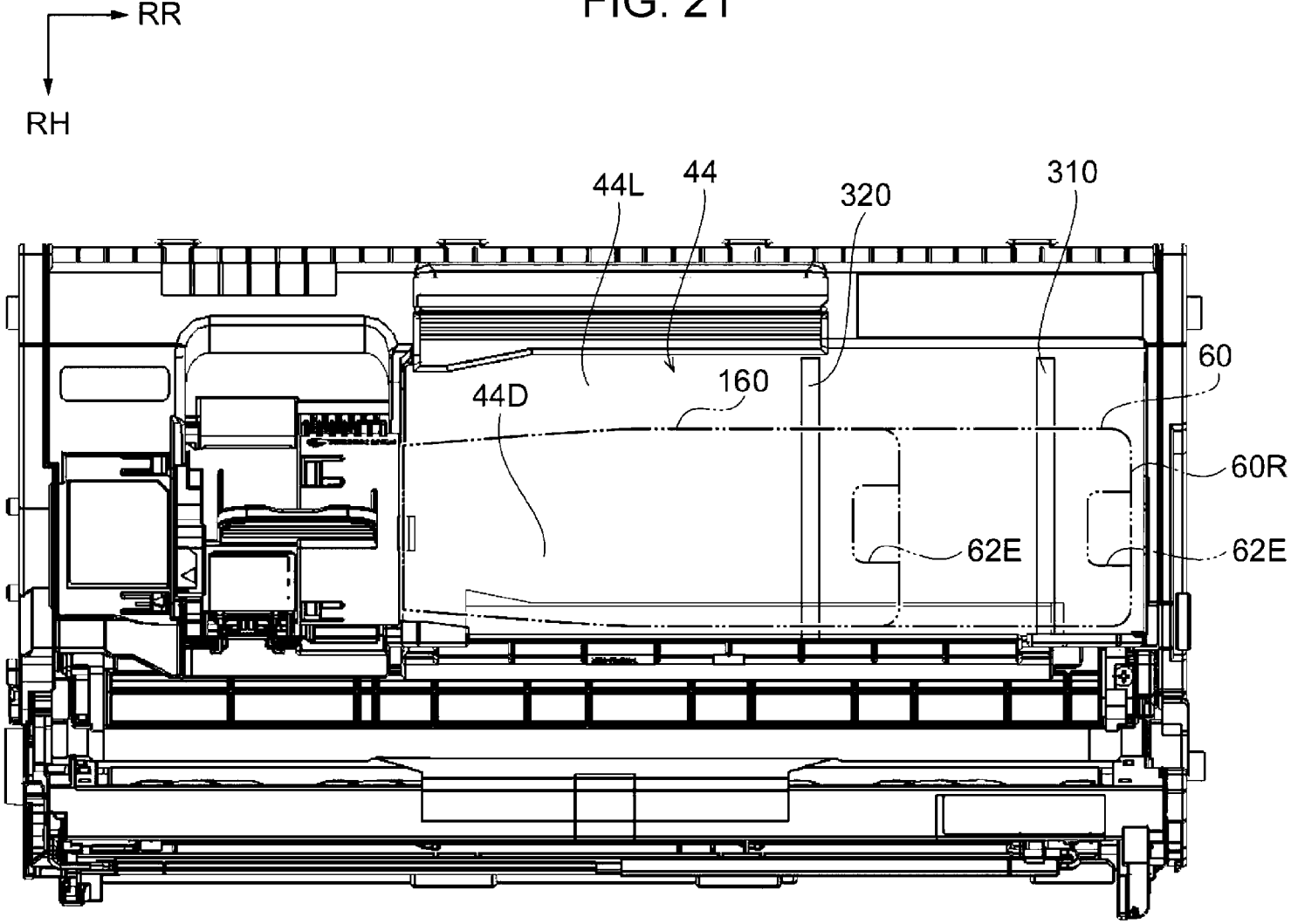
FIG. 21 is a plan view of the unit body according to the exemplary embodiment, illustrating a first projection and a second projection.
Figure 22:
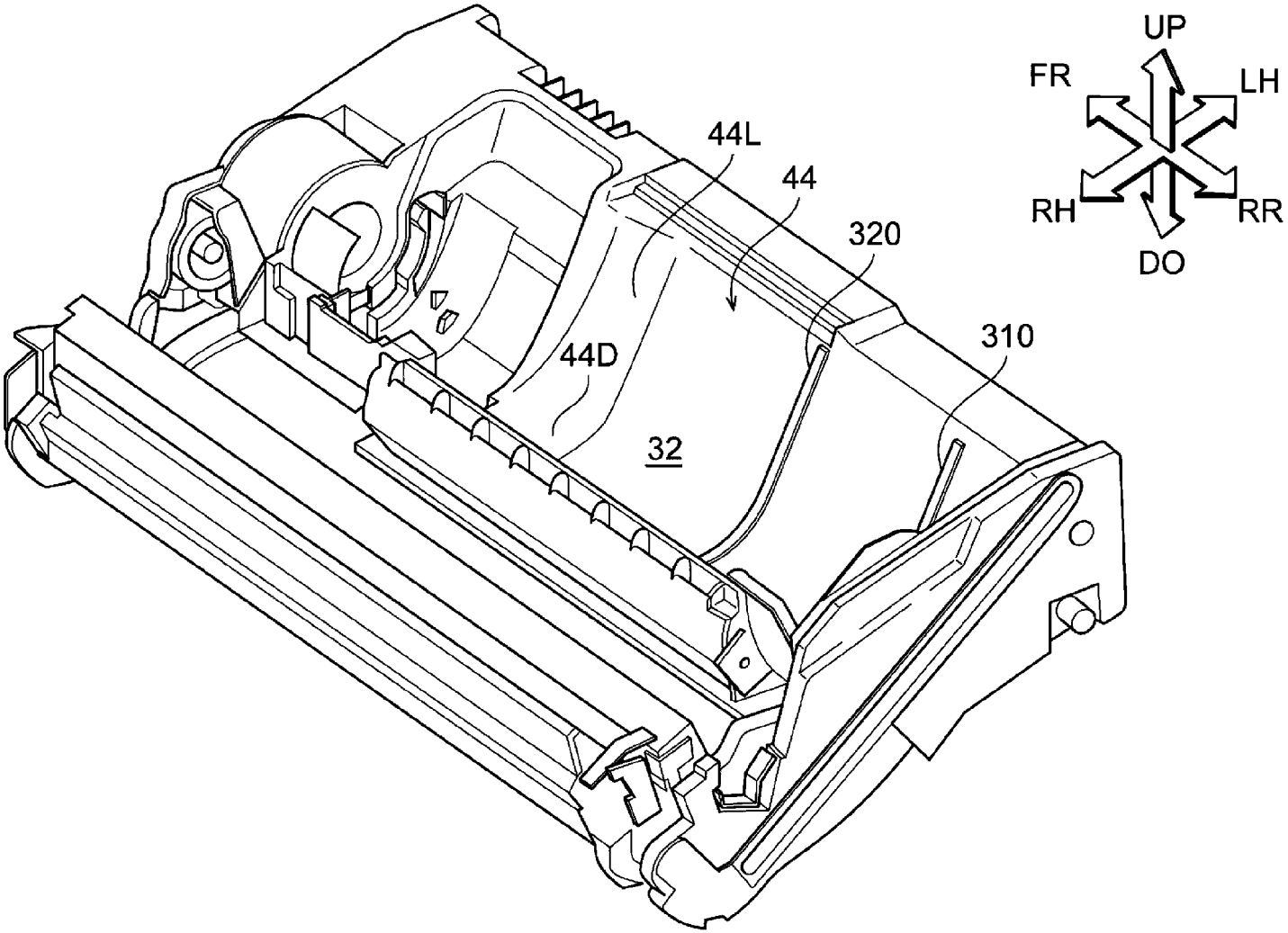
FIG. 22 is a perspective view of the unit body according to the exemplary embodiment, illustrating the first projection and the second projection.

As illustrated in FIGS. 21 and 22, the first projection 310 and the second projection 320 are provided on the rear peripheral wall 44. Specifically, the first projection 310 and the second projection 320 each extend over the bottom part 44D and the left side part 44L (see FIG. 9). The first projection 310 and the second projection 320 project from the rear peripheral wall 44.

Figure 23:
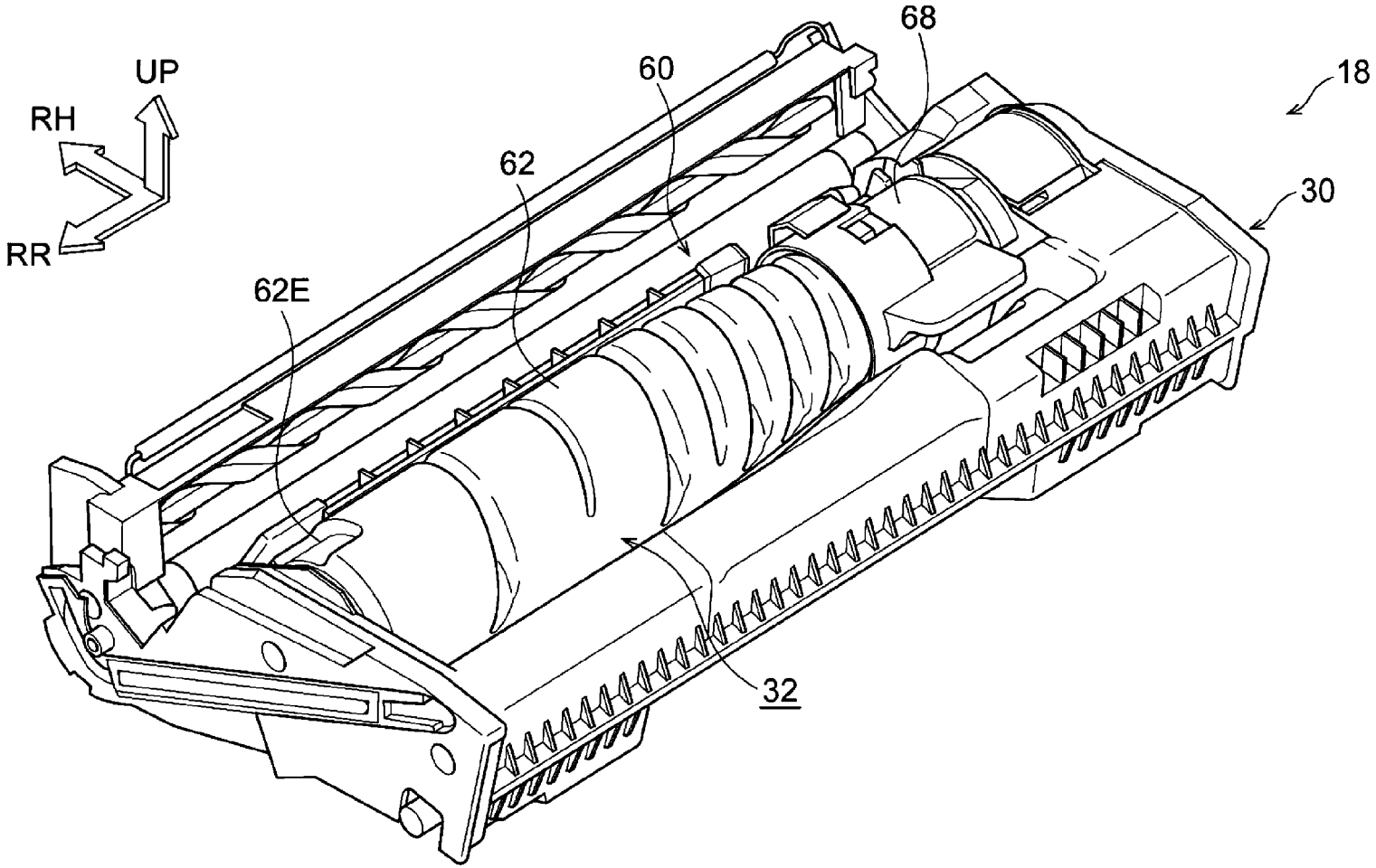
FIG. 23 is a perspective view of the storage container according to the exemplary embodiment that is set in a placing space.
Figure 24:
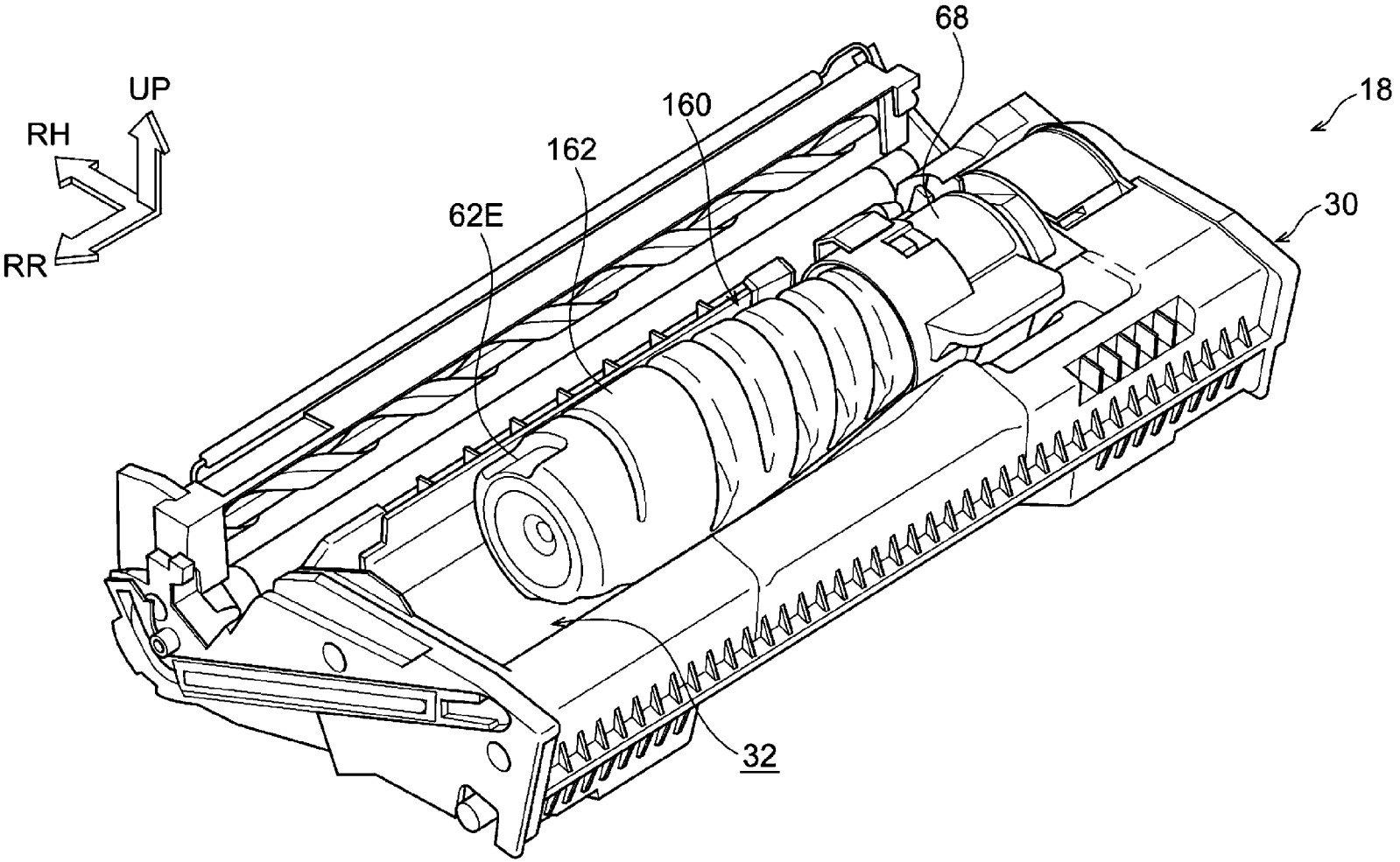
FIG. 24 is a perspective view of another storage container that is shorter in the axial direction than the storage container illustrated in FIG. 23 and is set in the placing space.

In the present exemplary embodiment, as illustrated in FIG. 24, a storage container 160 that is shorter in the front-rear direction (the axial direction) than the storage container 60 illustrated in FIG. 23 is also allowed to be placed in the placing space 32 and set in the unit body 30. The storage container 160 includes a lid portion 68 having the same configuration as the lid portion 68 of the storage container 60, and a storage portion 162 that is shorter in the axial direction than the storage portion 62 of the storage container 60. The storage container 60 is an exemplary first holding object. The storage container 160 is an exemplary second holding object.

The storage portion 62 of the storage container 60 and the storage portion 162 of the storage container 160 each have a recess 62E that is depressed from the outer peripheral surface at the rear end thereof.

The first projection 310 is higher than the second projection 320. If the storage container 60 is placed in the placing space 32 as illustrated in FIG. 23, the first projection 310 comes into contact with the outer peripheral surface (an exemplary cylindrical surface) of the storage portion 62 of the storage container 60 near the rear end of the storage portion 62 (see FIG. 21). Specifically, the first projection 310 comes into contact with the outer peripheral surface of the storage portion 62 at a position near the recess 62E of the storage portion 62. The position near the recess 62E refers to a position at a distance from the recess 62E that is shorter than the front-rear length of the recess 62E.

The second projection 320 is lower than the first projection 310 and does not come into contact with the outer peripheral surface of the storage portion 62 of the storage container 60. That is, only the first projection 310, not the second projection 320, comes into contact with the storage container 60.

If the storage container 160 is placed in the placing space 32 as illustrated in FIG. 24, the second projection 320 comes into contact with the outer peripheral surface of the storage portion 162 of the storage container 160 near the rear end of the storage portion 162 (see FIG. 21). That is, only the second projection 320, not the first projection 310, comes into contact with the storage container 160. Specifically, the second projection 320 comes into contact with the outer peripheral surface of the storage portion 162 at a position near the recess 62E of the storage portion 162.

Functions Exerted by Exemplary Embodiment

Functions exerted by the present exemplary embodiment will now be described.

In the present exemplary embodiment, the storage container 60 is placed into the placing space 32 (see FIG. 5) by bringing the storage container 60 from the upper side of the placing space 32 (see FIG. 3) toward the lower side into the placing space 32.

In this process, the outer peripheral surface 76A of the end part 76 of the lid portion 68 comes into contact with the sloping surface 132 and the arc surface 134 of the guiding portion 130 and is guided therealong toward the lower right side into the placing space 32 (see FIGS. 10 and 19).

Furthermore, the rear end of the outer peripheral surface 70A of the first cylinder 70 included in the lid portion 68 of the storage container 60 comes into contact with the sloping surface 232 and the arc surface 234 of the guiding portion 230 and is guided therealong toward the lower right side into the placing space 32 (see FIGS. 3 and 20).

As described above, the storage container 60 is guided at the front end and at the rear end of the lid portion 68 by the guiding portion 130 and by the guiding portion 230, respectively. Therefore, the storage container 60 is less likely to be tilted when being placed into the placing space 32 (on the bottom parts 42D and 44D) than in a configuration in which the storage container 60 is guided only at one end (the front end or the rear end) of the lid portion 68.

In the present exemplary embodiment, the storage container 60 placed in the placing space 32 is rotated counterclockwise in FIG. 7, whereby the storage container 60 is held by the supporting portion 110 and by the holding portion 220 (see FIG. 10) and is completely set in the unit body 30.

In the supporting portion 110, the pair of guiding protrusions 72D of the raised part 72B of the storage container 60 go into the pair of guiding grooves 115, whereby the raised part 72B of the lid portion 68 of the storage container 60 is held by the supporting portion 110. Furthermore, in the holding portion 220, the extended part 79 goes into the guiding groove 226 and is held by the guiding protrusion 222 (see FIG. 18). Thus, in the present exemplary embodiment, the front end of the lid portion 68 is held by the supporting portion 110 with the aid of the raised part 72B, and the rear end of the lid portion 68 is held by the holding portion 220 with the aid of the extended part 79.

Therefore, the orientation of the storage container 60 is less likely to change at the rotation of the storage portion 62 than in a configuration in which the lid portion 68 is held only at one end (the front end or the rear end) thereof.

Specifically, floating of the storage container 60 in the placing space 32 (above the bottom parts 42D and 44D) is suppressed.

Since the orientation of the storage container 60 is less likely to change, the speed of toner transport in the storage container 60 (the speed of toner discharge from the storage container 60) is less likely to change. Furthermore, since the speed of toner transport is less likely to change, the density of the image formed by the developing device 28 is less likely to change.

In the present exemplary embodiment, the supporting portion 110 not only holds the lid portion 68 but also openably and closably supports the openable-closable member 104 as described above. Therefore, the number of components is smaller than in a case where the holding portion that holds the lid portion 68 and the element that openably and closably supports the openable-closable member 104 are separate components.

In the present exemplary embodiment, a gap is provided between the rear wall 43 and the rear end surface 60R (see FIG. 5) of the storage container 60 that is in the unset position or in the set position. Furthermore, the rear end of the storage container 60 that is in the unset position or in the set position is unbound to the unit body 30.

Here, another configuration will be discussed in which the rear end of the storage container 60 that is in the unset position or in the set position is bound to the unit body 30. In such a configuration, for example, the center of the rear end surface 60R of the storage container 60 needs to be rotatably supported by using a protrusion protruding from the rear wall 43 toward the front side. Accordingly, only the storage container 60 including the storage portion 62 having a predetermined axial length is settable in the placing space 32. In contrast, in the present exemplary embodiment, as illustrated in FIGS. 23 and 24, a plurality of kinds of storage containers (for example, the storage container 60 and the storage container 160) including storage portions having different lengths are settable in the placing space 32 (on the bottom parts 42D and 44D).

In the present exemplary embodiment, as illustrated in FIG. 23, if the storage container 60 is placed in the placing space 32, the first projection 310 comes into contact with the outer peripheral surface (an exemplary cylindrical surface) of the storage portion 62 of the storage container 60 near the rear end of the storage portion 62 (see FIG. 21).

Furthermore, as illustrated in FIG. 24, if the storage container 160 is placed in the placing space 32, the second projection 320 comes into contact with the outer peripheral surface of the storage portion 162 of the storage container 160 near the rear end of the storage portion 162 (see FIG. 21).

Therefore, the resistance occurring at the rotation of the storage portion 62 or 162 is smaller than in a configuration in which the entirety of the storage portion 62 or 162 comes into contact with the rear peripheral wall 44.

In the present exemplary embodiment, in addition to the first projection 310, the second projection 320 that comes into contact with the storage portion 162 of the storage container 160 is provided. Therefore, the resistance occurring at the rotation of the storage portion 162 of the storage container 160 is smaller than in a configuration in which only the first projection 310 is provided.

In the present exemplary embodiment, the first projection 310 is higher than the second projection 320. Therefore, only the first projection 310, not the second projection 320, comes into contact with the storage portion 62 of the storage container 60. Accordingly, the resistance occurring at the rotation of the storage portion 62 of the storage container 60 is smaller than in a configuration in which the first projection 310 and the second projection 320 have the same height.

In the present exemplary embodiment, the first projection 310 comes into contact with the outer peripheral surface (an exemplary cylindrical surface) of the storage portion 62 of the storage container 60 near the rear end of the storage portion 62 (see FIG. 21). On the other hand, the second projection 320 comes into contact with the outer peripheral surface (an exemplary cylindrical surface) of the storage portion 162 of the storage container 160 near the rear end of the storage portion 162 (see FIG. 21). Therefore, the storage portion 62 or 162 is more assuredly retained in an orientation parallel to the front-rear direction than in a configuration in which the first projection 310 and the second projection 320 each come into contact with the outer peripheral surface of the storage portion 62 or 162 near the front end of the storage portion 62 or 162. That is, the storage portion 62 or 162 is less likely to be oriented with the rear end thereof being lowered.

In the present exemplary embodiment, the first projection 310 comes into contact with the outer peripheral surface of the storage portion 62 at a position near the recess 62E provided in the storage portion 62. Likewise, the second projection 320 comes into contact with the outer peripheral surface of the storage portion 162 at a position near the recess 62E provided in the storage portion 162.

Therefore, the outer peripheral surfaces of the storage portions 62 and 162 are less likely to deform than in a configuration in which the first projection 310 and the second projection 320 each come into contact with the storage portion 62 or 162 at a position far from the recess 62E.

Modifications

In the above exemplary embodiment, the supporting portion 110 not only holds the lid portion 68 but also openably and closably supports the openable-closable member 104 as described above. The present disclosure is not limited to such an embodiment. For example, the holding portion that holds the lid portion 68 and the supporting portion that openably and closably supports the openable-closable member 104 may be separate components.

In the above exemplary embodiment, the first projection 310 comes into contact with the storage portion 62 of the storage container 60, and the second projection 320 comes into contact with the storage portion 162 of the storage container 160. The present disclosure is not limited to such an embodiment. For example, the first projection 310 and the second projection 320 may be omitted, and the entirety of the storage portion 62 or 162 may come into contact with the rear peripheral wall 44.

In the above exemplary embodiment, in addition to the first projection 310, the second projection 320 that comes into contact with the storage portion 162 of the storage container 160 is provided. The present disclosure is not limited to such an embodiment. For example, only one of the first projection 310 and the second projection 320 may be provided.

In the above exemplary embodiment, the first projection 310 is higher than the second projection 320. The present disclosure is not limited to such an embodiment. For example, the first projection 310 and the second projection 320 may have the same height.

In the above exemplary embodiment, the first projection 310 comes into contact with the storage portion 62 of the storage container 60 near the rear end of the storage portion 62, and the second projection 320 comes into contact with the storage portion 162 of the storage container 160 near the rear end of the storage portion 162. The present disclosure is not limited to such an embodiment. For example, the first projection 310 and the second projection 320 may each come into contact with a corresponding one of the storage portions 62 and 162 near the front end of the storage portion 62 or 162.

In the above exemplary embodiment, the image forming unit 18 includes the storage container 60. The present disclosure is not limited to such an embodiment. That is, the storage container 60 is regarded as one of the elements of the image forming unit 18. The present disclosure is not limited to such an embodiment. For example, the image forming unit 18 and the storage container 60 may be regarded as separate elements.

The present disclosure is not limited to the above exemplary embodiment, and various modifications, changes, and improvements may be made thereto within the scope thereof. For example, the above modifications may be combined in any way, according to need.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A rotating device comprising:

a body having a bottom wall extending in one direction;

a holding object including a rotating portion extending in the one direction and a supporting portion supporting the rotating portion at one end of the rotating portion in the one direction such that the rotating portion is rotatable on an axis extending in the one direction, the holding object being provided on the bottom wall;

a first holding portion provided on the body and holding the supporting portion of the holding object at one end of the supporting portion in the one direction;

a second holding portion provided on the body and holding the supporting portion of the holding object at an other end of the supporting portion in the one direction; and a transmitting portion provided on the body and transmitting a rotational force to the rotating portion of the holding object.

2. The rotating device according to claim 1, wherein the first holding portion supports an openable-closable member such that the openable-closable member is rotatable to open and close an opening provided in the body.

3. A rotating device comprising:

a body having a bottom wall extending in one direction;

a holding object including a rotating portion extending in the one direction and a supporting portion supporting the rotating portion at one end of the rotating portion in the one direction such that the rotating portion is rotatable on an axis extending in the one direction, the holding object being placed on the bottom wall by being moved in an approaching direction from an upper side of the bottom wall toward the bottom wall;

a first guiding portion provided on the body and guiding the supporting portion in the approaching direction at one end of the supporting portion in the one direction;

a second guiding portion provided on the body and guiding the supporting portion in the approaching direction at an other end of the supporting portion in the one direction; and a transmitting portion provided on the body and transmitting a rotational force to the rotating portion of the holding object.

4. The rotating device according to claim 1, wherein the holding object is moved in an approaching direction from an upper side of the bottom wall toward the bottom wall, and wherein the rotating device further includes a first guiding portion provided on the body and guiding the supporting portion in the approaching direction at the one end of the supporting portion; and a second guiding portion provided on the body and guiding the supporting portion in the approaching direction at the other end of the supporting portion.

5. The rotating device according to claim 2, wherein the holding object is moved in an approaching direction from an upper side of the bottom wall toward the bottom wall, and wherein the rotating device further includes a first guiding portion provided on the body and guiding the supporting portion in the approaching direction at the one end of the supporting portion; and a second guiding portion provided on the body and guiding the supporting portion in the approaching direction at the other end of the supporting portion.

6. The rotating device according to claim 3, wherein the first guiding portion and the second guiding portion each include a first surface forming a descending slope extending in the approaching direction; and a second surface forming a descending slope extending in the approaching direction from a lower end of the first surface and sloping at a greater angle than the descending slope formed of the first surface.

7. The rotating device according to claim 4, wherein the first guiding portion and the second guiding portion each include a first surface forming a descending slope extending in the approaching direction; and a second surface forming a descending slope extending in the approaching direction from a lower end of the first surface and sloping at a greater angle than the descending slope formed of the first surface.

8. The rotating device according to claim 5, wherein the first guiding portion and the second guiding portion each include a first surface forming a descending slope extending in the approaching direction; and a second surface forming a descending slope extending in the approaching direction from a lower end of the first surface and sloping at a greater angle than the descending slope formed of the first surface.

9. The rotating device according to claim 1, wherein when the holding object is held by the first holding portion and the second holding portion, the other end of the rotating portion in the one direction is unbound to the body.

10. The rotating device according to claim 2, wherein when the holding object is held by the first holding portion and the second holding portion, the other end of the rotating portion in the one direction is unbound to the body.

11. The rotating device according to claim 1, wherein the body includes an opposing wall facing, in the one direction, a surface of the rotating portion of the holding object that is at the other end in the one direction when the holding object is held by the first holding portion and the second holding portion, and wherein a gap is provided between the opposing wall and the surface.

12. The rotating device according to claim 2, wherein the body includes an opposing wall facing, in the one direction, a surface of the rotating portion of the holding object that is at the other end in the one direction when the holding object is held by the first holding portion and the second holding portion, and wherein a gap is provided between the opposing wall and the surface.

13. The rotating device according to claim 1, wherein a periphery of the rotating portion forms a cylindrical surface, and wherein the rotating device further includes a projection projecting from the bottom wall and coming into contact with the cylindrical surface of the rotating portion.

14. The rotating device according to claim 13, wherein the projection includes a first projection that comes into contact with the cylindrical surface of the rotating portion of the holding object as a first holding object, and a second projection that comes into contact with a cylindrical surface of a rotating portion of an other holding object as a second holding object, the rotating portion of the second holding object being shorter in the one direction than the rotating portion of the first holding object.

15. The rotating device according to claim 14, wherein the first projection has a greater height from the bottom wall than the second projection.

16. The rotating device according to claim 13, wherein the projection comes into contact with the cylindrical surface of the rotating portion near the other end of the rotating portion in the one direction.

17. The rotating device according to claim 16, wherein the cylindrical surface of the rotating portion has a recess at the other end of the rotating portion, and wherein the projection comes into contact with the cylindrical surface at a position near the recess.

18. The rotating device according to claim 1, wherein the holding object stores powder in the rotating portion and transports the powder toward the one end of the rotating portion when the rotating portion is rotated.

19. An image forming apparatus comprising:

an image-forming-apparatus body; and the rotating device according to claim 18 including a developing device that is attachable to and detachable from the image-forming-apparatus body and develops a latent image, the rotating device supplying toner as the powder to the developing device.

20. A rotating device comprising:

a body having a bottom wall extending in one direction, the body carrying, on the bottom wall, a holding object including a rotating portion extending in the one direction and a supporting portion supporting the rotating portion at one end of the rotating portion in the one direction such that the rotating portion is rotatable on an axis extending in the one direction;

a first holding portion provided on the body and holding the supporting portion of the holding object at one end of the supporting portion in the one direction;

a second holding portion provided on the body and holding the supporting portion of the holding object at an other end of the supporting portion in the one direction; and a transmitting portion provided on the body and transmitting a rotational force to the rotating portion of the holding object.

* * * * *